US007290949B1

(12) United States Patent
Phillips et al.

(10) Patent No.: US 7,290,949 B1
(45) Date of Patent: Nov. 6, 2007

(54) LINE PRINTER HAVING A MOTORIZED PLATEN THAT AUTOMATICALLY ADJUSTS TO ACCOMMODATE PRINT FORMS OF VARYING THICKNESS

(75) Inventors: Scott D Phillips, Kent, WA (US); Joel C Brown, Renton, WA (US); Craig J Cornelius, Woodinville, WA (US); Kenneth R Hallock, Buckley, WA (US); Daniel A Durland, Seattle, WA (US); Gary A Gesellchen, Seattle, WA (US); Christopher J Bakken, Auburn, WA (US)

(73) Assignee: TallyGenicom LP, Kent, WA (US)

( * ) Notice: Subject to any disclaimer, the term of this patent is extended or adjusted under 35 U.S.C. 154(b) by 0 days.

(21) Appl. No.: 11/248,543

(22) Filed: Oct. 12, 2005

(51) Int. Cl.
*B41J 11/20* (2006.01)

(52) U.S. Cl. ..... 400/56; 400/55; 347/8

(58) Field of Classification Search ..... 400/55, 400/56; 347/8; 702/170
See application file for complete search history.

(56) References Cited

U.S. PATENT DOCUMENTS

| | | | |
|---|---|---|---|
| 3,981,235 | A | 9/1976 | Thomas et al. |
| 4,178,106 | A | 12/1979 | Mailer et al. |
| 4,652,153 | A | 3/1987 | Kotsuzumi et al. |
| 4,812,059 | A | 3/1989 | Masaki |
| 4,881,835 | A | 11/1989 | Niikawa |
| 4,917,512 | A | 4/1990 | Mimura et al. |
| 4,929,102 | A | 5/1990 | Mizutani et al. |
| 5,051,008 | A | 9/1991 | Honda et al. |
| 5,118,209 | A | 6/1992 | Bennet et al. |
| 5,137,377 | A | 8/1992 | Ito et al. |
| 5,205,658 | A | 4/1993 | Iriguchi |
| 5,257,867 | A | 11/1993 | Ito et al. |
| 5,445,458 | A | 8/1995 | Uchiyama |
| 5,468,076 | A | 11/1995 | Hirano et al. |
| 5,474,391 | A | 12/1995 | Andou et al. |
| 5,518,324 | A | 5/1996 | Campbell et al. |
| 5,570,959 | A | 11/1996 | Moriwaki et al. |
| 5,772,339 | A | 6/1998 | Yamaguchi |
| 6,367,909 | B1 | 4/2002 | Lean |
| 6,431,771 | B2 | 8/2002 | Nagai et al. |
| 6,497,466 | B1 | 12/2002 | Writt |
| 6,502,058 | B1 | 12/2002 | Nakamura et al. |

(Continued)

FOREIGN PATENT DOCUMENTS

| | | | |
|---|---|---|---|
| JP | 62208957 | * | 9/1987 |

(Continued)

*Primary Examiner*—Daniel J. Colilla
*Assistant Examiner*—Marissa Ferguson-Samreth
(74) *Attorney, Agent, or Firm*—Christensen O'Connor Johnson Kindness PLLC

(57) ABSTRACT

Methods for setting the print gap in a printer are disclosed. The printer has an eccentric platen wherein rotation of the platen changes the print gap distance. A driver controls the eccentric platen rotation, and a sensor may be used to determine the position of the motor and platen. The configuration of an eccentric platen and a driver having a position sensor enables measuring the thickness of a form at one or more locations to create a representative thickness profile of the form, which may be saved to the printer's computer memory and repeated when printing similar forms in the future, thus obviating the need to measure the thickness of every individual form.

29 Claims, 25 Drawing Sheets

U.S. PATENT DOCUMENTS

| | | | |
|---|---|---|---|
| 6,616,355 | B2 | 9/2003 | Cleary et al. |
| 2001/0021330 | A1 | 9/2001 | Kishida et al. |
| 2002/0015606 | A1 | 2/2002 | Bradfield |
| 2004/0189726 | A1 | 9/2004 | Youn et al. |
| 2005/0002713 | A1 | 1/2005 | Silverbrook |
| 2005/0083369 | A1 | 4/2005 | Silverbrook |

FOREIGN PATENT DOCUMENTS

| | | | | |
|---|---|---|---|---|
| JP | 63-7960 | A | | 1/1988 |
| JP | 2-1356 | A | | 1/1990 |
| JP | 02011358 | | * | 1/1990 |
| JP | 2-261684 | A | | 10/1990 |
| JP | 3-118175 | A | | 5/1991 |
| JP | 4023411 | | * | 2/1992 |
| JP | 4-97873 | A | | 3/1992 |
| JP | 4-197665 | A | | 7/1992 |
| JP | 4-216971 | A | | 8/1992 |
| JP | 5-201094 | A | | 8/1993 |
| JP | 05286152 | | * | 11/1993 |
| JP | 06155854 | | * | 6/1994 |
| JP | 06270480 | | * | 9/1994 |
| JP | 08011365 | | * | 1/1996 |
| JP | 8-156352 | A | | 6/1996 |
| JP | 9-71021 | A | | 3/1997 |
| JP | 411320836 | | * | 11/1999 |

* cited by examiner

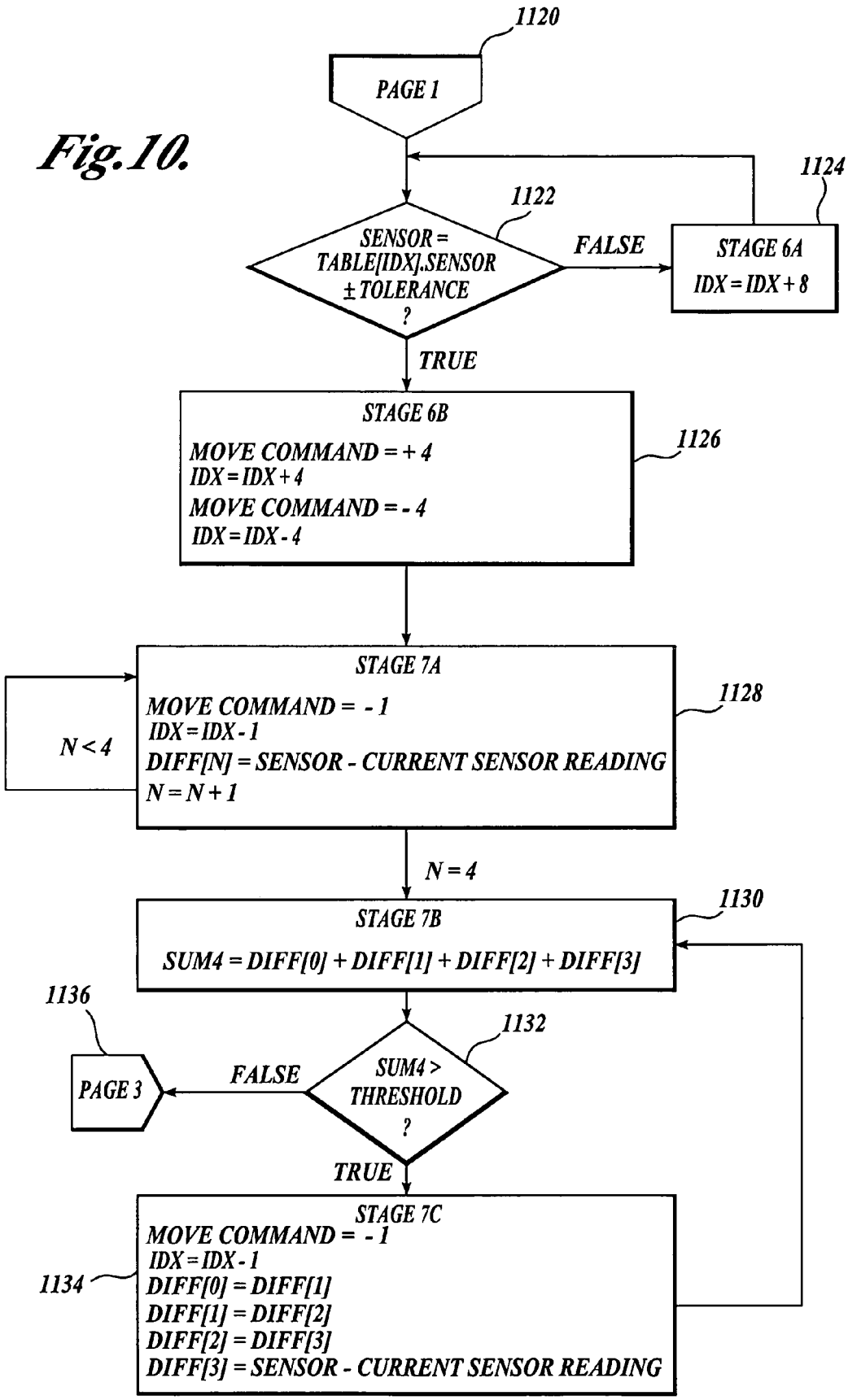
Fig.10.
1120
PAGE 1
1122
SENSOR = TABLE[IDX].SENSOR ± TOLERANCE ?
FALSE
1124
STAGE 6A
IDX = IDX + 8
TRUE
STAGE 6B
MOVE COMMAND = + 4
IDX = IDX + 4
MOVE COMMAND = - 4
IDX = IDX - 4
1126
STAGE 7A
MOVE COMMAND = - 1
IDX = IDX - 1
DIFF[N] = SENSOR - CURRENT SENSOR READING
N = N + 1
N < 4
1128
N = 4
STAGE 7B
SUM4 = DIFF[0] + DIFF[1] + DIFF[2] + DIFF[3]
1130
1136
PAGE 3
FALSE
1132
SUM4 > THRESHOLD ?
TRUE
STAGE 7C
MOVE COMMAND = - 1
IDX = IDX - 1
DIFF[0] = DIFF[1]
DIFF[1] = DIFF[2]
DIFF[2] = DIFF[3]
DIFF[3] = SENSOR - CURRENT SENSOR READING
1134

LINE PRINTER HAVING A MOTORIZED PLATEN THAT AUTOMATICALLY ADJUSTS TO ACCOMMODATE PRINT FORMS OF VARYING THICKNESS

FIELD OF THE INVENTION

The present invention relates generally to methods and apparatus for printing, and more specifically, to methods and apparatus for setting the correct print gap, and automatically adjusting the print gap, for forms of varying thickness.

BACKGROUND OF THE INVENTION

In a line-impact, dot-matrix printer (LIDM printer), the distance between the impact hammers and the platen has an effect on the print quality. Since this type of printer can type on paper forms of various thicknesses, it is often necessary to adjust the distance between the impact hammers and the platen for optimum printing performance. If the distance is too large, the impact hammers do not strike the ink ribbon with enough force to transfer the ink from the ribbon to the paper. If the distance is too small, there will likely be smudging on the paper due to the hammers pressing the ribbon against the paper even when the hammers are retracted.

In conventional LIDM type printers, the distance between the platen and the impact hammers is adjusted manually. Adjustment typically begins by setting a large distance and then reducing the distance until ribbon smudging appears on the paper. The distance is then increased slightly until the smudging disappears. Arriving at the optimal distance requires some experience on the part of the user, and the process must be repeated each time a new supply of paper is loaded into the printer.

Much time would be saved if the adjustment of the distance between the platen and the impact hammers could be done automatically, without the user manually moving either the platen or impact hammers. Additionally, consistent printer performance would inevitably result as well. The problem is developing an automatic approach for determining and setting the optimal print gap distance.

SUMMARY OF THE INVENTION

In one aspect, a method of setting a "print gap" of a printer includes rotating an "eccentric" platen to set the print gap distance based upon a measured thickness of a "printing medium." The print gap is the distance between the surface of the platen and the impact hammers. An eccentric platen is one that defines an outer surface whose distance from the center of rotation varies based on the angular position of the platen. Therefore, when the platen is rotated, the print gap distance is made to vary. A printing medium is any material that may be imprinted by the printer, such as paper, forms, and the like. In the method according to the invention, there may be various ways of measuring printing medium thickness. Some embodiments may measure the thickness directly, other embodiments may not measure the thickness directly, but may take a measure of a printing medium that is proportional to the thickness. For example, one method of determining a measure of thickness includes applying a known force against the printing medium. Once the printing medium thickness is determined by direct measurement or through a related measurement, the printer may access a table or data structure, wherein the optimal print gap is a function of the thickness of the printing medium. When the optimal print gap is determined, the eccentric platen may be commanded to move to set the correct print gap.

An automatic print gap adjustment feature can provide for other enhancements to the printer. Printing media, such as forms, often come in thicknesses that vary down the length of the page. Unfortunately, a print gap that may work well on a thick portion of the form may result in light print on the thin portion of the form. Conversely, a print gap that prints well on the thin portion of the form can result in smudging of ink on the thick portion of the form. If the thickness of the printing medium could be measured at locations where the relative thin and thick portions occur, the printer could automatically adjust the print gap when a thin or a thick portion of the printing medium is being printed. The determination of the thicknesses of a printing medium at more than one location is referred to herein as "profiling" the printing medium. Once the profile of a single printing medium is stored in the memory of a printer, the print gap distance can be automatically set to print a plurality of similar printing media with similar thickness profiles. To profile a form, a representative form is initially moved through the platen gap from top to bottom. At every ⅙" location down the form, for example, the print gap is determined and stored in memory. The location and corresponding print gap information is later used to adjust the print gap while printing to accommodate the varying thicknesses of similar forms and maintain high print quality over the entire form from top to bottom or side to side.

In one embodiment of measuring the printing medium for thickness, a force is applied to the printing medium by a driver. To this end, an eccentric platen is rotated by the driver to decrease the print gap, eventually abutting against the printing medium which in turn abuts against the ribbon and impact hammers. At some point, the driver will be unable to rotate the platen. This position, known as the crush point, is reached when the form is compressed against the ribbon and impact hammers. The crush point can be detected through the use of a rotary position sensor, such as a potentiometer. This sensor is monitored to detect when the motor speed drops. The platen position indicated by the sensor is then recorded as the crush point for the particular form. Software running on the printer's computer system uses the crush point to determine the platen position that results in the optimal print gap.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 10 is a flow diagram of a method for setting the print gap of a printer;

DETAILED DESCRIPTION OF THE PREFERRED EMBODIMENT

A method for setting the print gap distance by rotational change of an eccentric platen is described. A stepper motor can be used to rotate the eccentric platen. The stepper motor may have a rotary potentiometer or similar sensor attached to the motor shaft. The sensor may be used to verify that the platen has arrived at the commanded position. An eccentric platen, a stepper motor, and a sensor may be used to determine printing medium thickness before setting the print gap. Thickness is determined by applying a force against the printing medium with the eccentric platen, and recording the position of the platen. If the position of the platen is known, and the print gap distance is known as a function of the platen position, and the optimal print gap distance is known for a given paper thickness, the appropriate print gap distance may be set automatically. The optimal print gap may vary based on a number of factors, such as printer type, printing medium type, and the thickness of the printing medium. Print gap distance and printing medium thickness may not be measured directly for feedback in control, but may be assumed from other inputs of a more readily controllable and measurable input variable, such as the motor electrical step, for example. In the description of this invention, a particular stepper motor with a specific configuration is described, however, it is to be understood that the invention is not to be limited to the specifics of the stepper motor.

Figure 1:
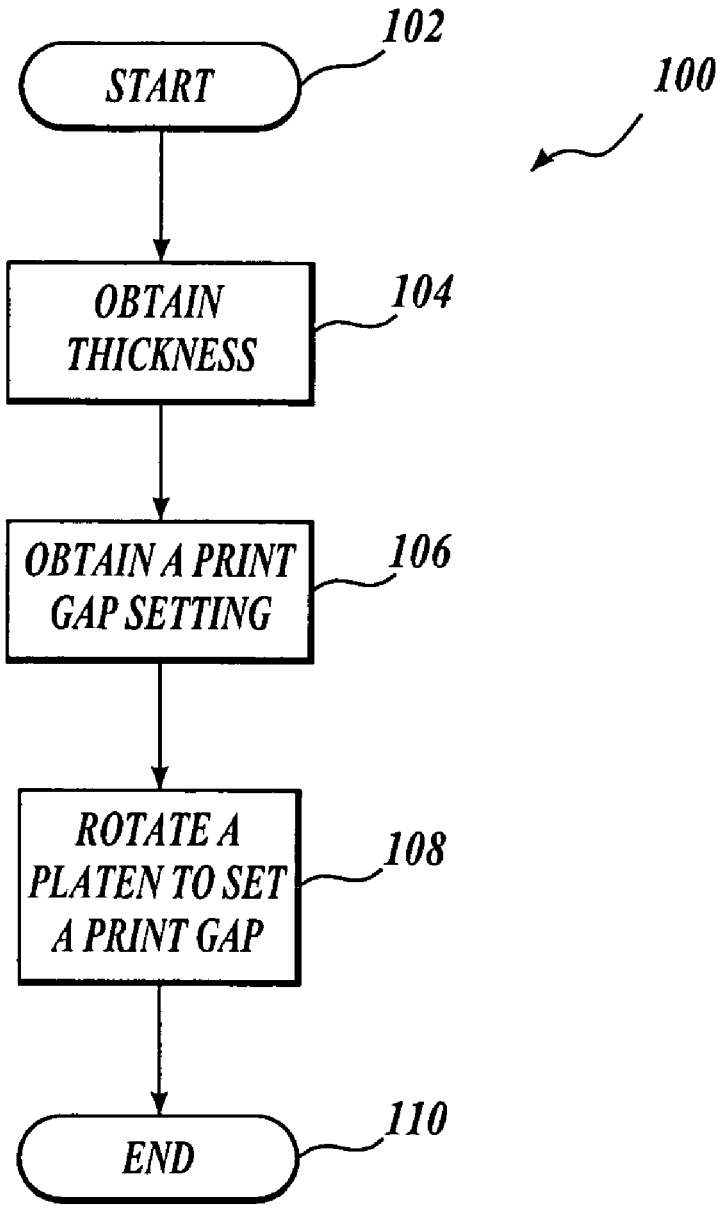
FIG. 1 is a flow diagram of a method for setting a print gap automatically.

Referring to FIG. 1, a flow diagram of a method 100 for setting the print gap of a printer is illustrated. The method 100 begins at start block 102. From start block 102, the method 100 enters block 104. Block 104 is for determining the paper thickness. From block 104, the method 100 enters block 106. In block 106, once a paper thickness has been determined, a print gap can be determined. From block 106, the method 100 enters block 108. In block 108, the print gap of the printer is set automatically. Automatically, as used herein when referring to setting the print gap, means that the print gap distance is adjusted by machine, usually through the movement of a platen, and particularly through rotation of an eccentric platen. From block 108, the method 100 enters block 110. In block 110, one iteration of method 100 is completed. The printer may now be set to print on the paper for which the paper thickness was determined initially in block 104.

As will be discussed below, there are various methods for determining the paper thickness. Any one of the methods for determining the paper thickness may be used that includes applying a force against the paper or measuring the thickness directly. However, some methods of determining the paper thickness may have disadvantages. The method chosen for determining the paper thickness generally will depend on the equipment available and the configuration of the printer system.

Generally, the optimal print gap for any given paper will vary with printer, and may even vary between individual printers of the same model type. A curve defining the optimal print gap can be created, such that the print gap of a given printer is a function of the paper thickness. Because paper is compressible, the "crush point" of the paper may be measured as opposed to an actual "thickness." Crush point is defined as the point at which a given motor will stall because the motor has insufficient torque to compress the paper further. Crush point is proportional to paper thickness, and a measure of the crush point may be used rather than an actual paper thickness.

Different approaches to determining thickness are possible with a stepper motor. One approach is referred to herein as "overstepping" the motor. A second approach takes advantage of a sensor to indicate the motor position at each step. Overstepping the motor includes stepping through all motor steps to drive the platen into the paper followed by reversing direction and stepping through all motor steps to a reference starting position while counting the steps needed to reach the reference starting position. The reference position may be known to be reached if indicated by a limit switch. Overstepping applies an unknown force when compressing the paper because one cannot determine how far the motor rotor lags in relation to the electrical step.

In an alternate approach, a sensor may be used to indicate the motor position and the platen position. In this approach, the limit of platen travel both to and away from the paper can be detected using the sensor to determine when the motor has stopped, either because the platen cannot compress the paper further or the platen has reached the reference starting position. A mechanical limiter, such as a stop pin, may be used to limit the platen travel at the reference position. The events of the platen contacting the stop pin or the paper are both seen by the sensor as the motor rotor not moving as far as commanded. By knowing the rotation direction, either event can be determined. The actual event of contact will also look different between these two conditions. When the platen contacts the stop pin, rotation of the motor rotor will be stopped abruptly. In the case of the platen contacting paper, rotation of the rotor will be gradually retarded until the torque of the motor is unable to compress the paper any further. At this point, the rotor will stop moving. Unlike the variable force applied during paper thickness detection with overstepping, a motor that includes a sensor enables applying the same compressive force to all paper types. Once the platen comes in contact with the paper, the motor will begin to lag the commanded step position. As the platen continues its compression, the paper will resist compressing further, causing the motor to lag even more. The torque of the motor will be at a maximum when the rotor lags the commanded step position by 90 degrees. This condition can be detected by comparing the changing sensor readings to expected values. When the readings indicate that maximum torque has been reached, further step commands are ceased and the platen position is recorded. By using the sensor to halt paper compression when the lead angle reaches 90 degrees, the force applied will be the same for all paper types. This approach also keeps the rotor in synchronization with the electrical step position, unlike the ambiguity inherent in overstepping. Once the platen reaches maximum compression against the paper, the platen does not need to move back to the limit in the opposite direction before going to the optimum print gap position. This makes the approach using a sensor for arriving at the optimal print gap much quicker than the approach without a sensor.

A motor with a sensor also allows the position of the platen to be constantly monitored. The sensor may be used to detect if the platen has been moved off its commanded step position by an obstruction in the system. The sensor may also be used to detect when the platen fails to reach a commanded position. Once this has been detected, the sensor reading can be used to generate a corrective positioning command.

Figure 2:
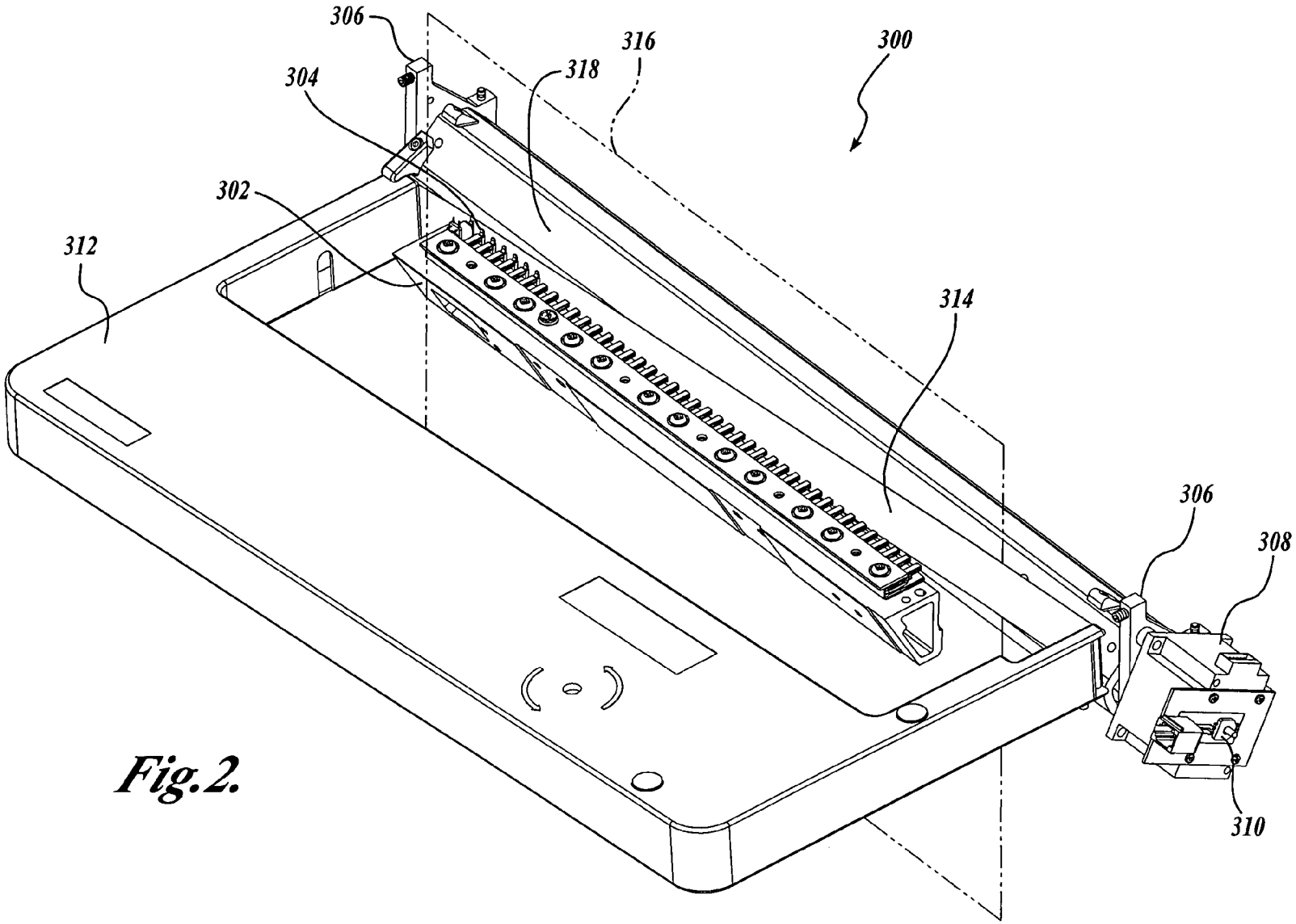
FIG. 2 is a diagrammatical illustration of a printer hammer bank, ribbon cartridge, and platen assembly.

Referring to FIG. 2, a printer assembly 300 of an LIDM-type printer to carry out a method of print gap adjustment with a stepper motor and sensor is shown. The majority of the printer components are omitted for ease of understanding and brevity. Furthermore, the description with reference to an LIDM-type printer is merely to illustrate one embodiment of the invention, and should not be construed to limit the invention to any type of printer. As shown, the printer assembly 300 includes a ribbon cartridge 312, a hammer bank 302, a plurality of impact hammers 304, paper 316 (in phantom), ribbon 314, a platen 318, a stepper motor 308, and a sensor 310. The platen 318 is held within two adjust plates 306, about which platen 318 may rotate. The ribbon cartridge 312 contains the ribbon 314 containing ink. The hammer bank 302 includes the individual impact hammers 304 aligned along the length of the hammer bank 302. The impact hammers 304 are individually selected to "fire" during printing. The hammer bank 302 includes a plurality of dot printing elements, with the hammer bank being translated to allow for printing all dot positions. The platen 318 is a moveable anvil aligned with the hammer bank 304 and receives the impact force created by the individual impact hammers 304. The platen 318 is an elongated member, having an eccentric cross-sectional configuration. The variation in the rotational radius of the platen's 318 surface allows adjustment of the distance between the surface of the platen 318 and the retracted position of the impact hammers 304. This distance is referred to in this application as the "print gap." The ribbon 314 from the ribbon cartridge 312 passes lengthwise between the platen's 318 surface and the impact hammers 304. The paper 316 may be inserted between the ribbon 314 and the surface of the platen 318. Upon actuation of an impact hammer 304, the impact hammer 304 forces the ribbon 314 against the paper 316, creating the image on the paper 316. The sensor 310 is used to monitor the angular position of the platen 318 and is attached to a protruding end of the shaft of the stepper motor 308. The sensor 310 provides the position of the platen 318 relative to a defined, predetermined reference.

In one embodiment, the platen sensor 310 is an angle sensing potentiometer with an effective rotational angle of 333.3 degrees. A representative sensor 310 can have an output voltage that increases or decreases depending upon the angular position of the platen 318. A representative sensor 310 may be connected across five volts and the center tab connected to a microprocessor analog-to-digital input. This analog-to-digital input has a 10-bit resolution. For every four half-steps of the stepper motor 308, the sensor 310 reading should change by approximately 11 counts. This is based on the following equation (Eq. 1):

$$1023 \text{ counts} \div 333.3° \times 0.9° \div \text{half-step} = 2.76 \text{ counts per half-step} \quad \text{(Eq. 1)}$$

Software programmed in the printer's computer memory and executed by a processor limits the rotation of the platen 318 to 255 half-steps. Since each half-step equals 0.9 degrees, this equates to 229.5 degrees of platen 318 rotation. The limits of the platen's 318 travel may be referred to as "fully open" and "fully closed." "Fully open" is considered half-step 255, while "fully closed" is considered half-step zero (0). In this application, the stepper motor 308 is described moving in half-step increments. However, this is merely to illustrate one embodiment, and should not be construed to limit the invention.

Stepper motor 308 may come in many variations. Stepper motors, in general, may convert digital pulses into an angular rotation. The amount of angular rotation is proportional to the number of pulses. The speed of angular rotation is generally proportional to the frequency of the pulses. The resolution, i.e., the number of steps, and the amount of angular rotation associated with a single step or half-step of a stepper motor 308 is generally dependent on the number of rotor pole pairs, the number of motor phases, and the drive mode (either full or half-step). Stepper motors with more or less than any of the variables described above can be used. Furthermore, stepper motor 308 is merely one example of a driver that can drive the platen 318. It is possible to use other driver devices that may not be stepper motors to drive platen 318.

Figure 3:
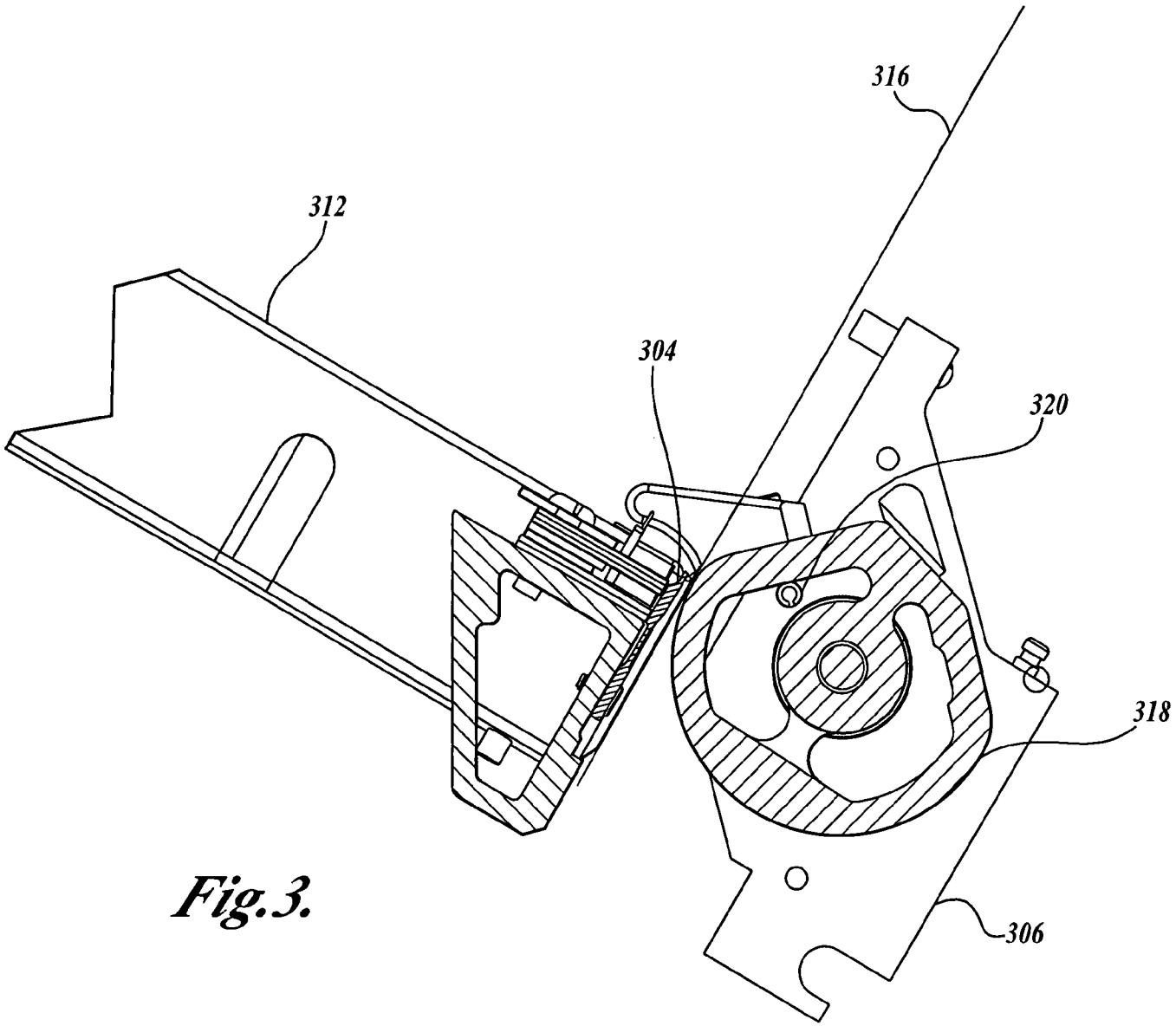
FIG. 3 is a cross-sectional illustration of a hammer bank, ribbon cartridge, and platen assembly.

Referring to FIG. 3, a cross-sectional illustration of the assembly of FIG. 2 is provided. A single impact hammer 304 is shown in its closest proximity to the platen 318. The platen 318 can now clearly be seen to have an eccentric cross-sectional configuration. In other words, as the platen 318 is rotated about its axis of rotation, the distance between the surface of the platen 318 and the impact hammer 304 will vary. The platen 318 may include an axle captured within the platen 318 to hold the platen 318 between the two adjust plates 306, of which only one is being illustrated in FIG. 3. The adjust plates 306 hold the platen 318 to the frame of the printer. The frame of the printer is not shown, for clarity and brevity. The adjust plates 306 may translate the platen 318 toward or away from the hammerbank by use of adjust screws. One end of the platen's 318 axle may be connected to the stepper motor 308 (FIG. 2). A mechanical stop pin 320 sets the limit of travel of the platen 318, and marks the reference position to which the sensor 310 may be calibrated. The stop pin 320 is shown abutting against the edge of a notch in the inside cavity of platen 318 to prevent further rotation.

Figure 4:
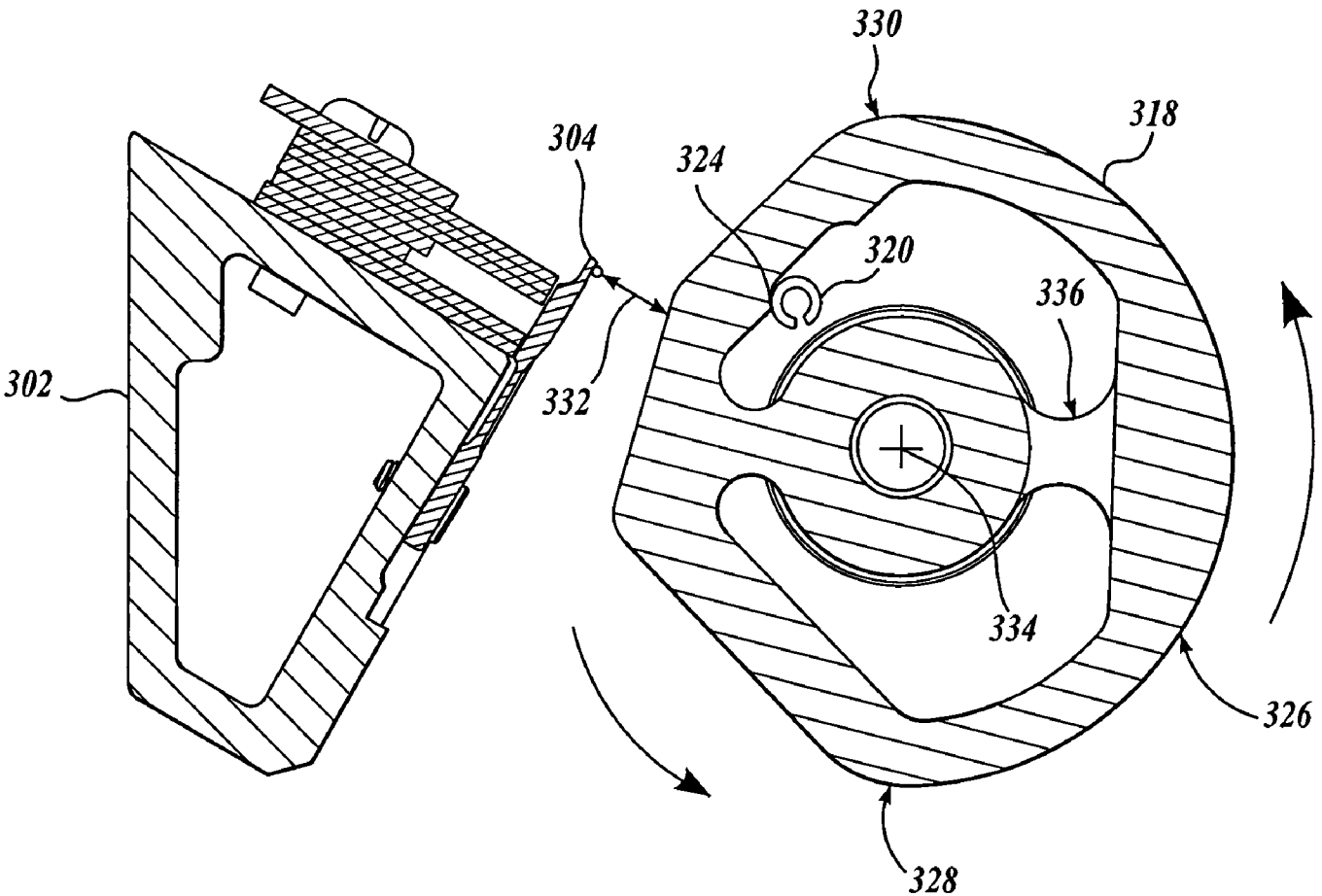
FIG. 4 is a cross-sectional illustration of a hammer bank and platen assembly.
Figure 5:
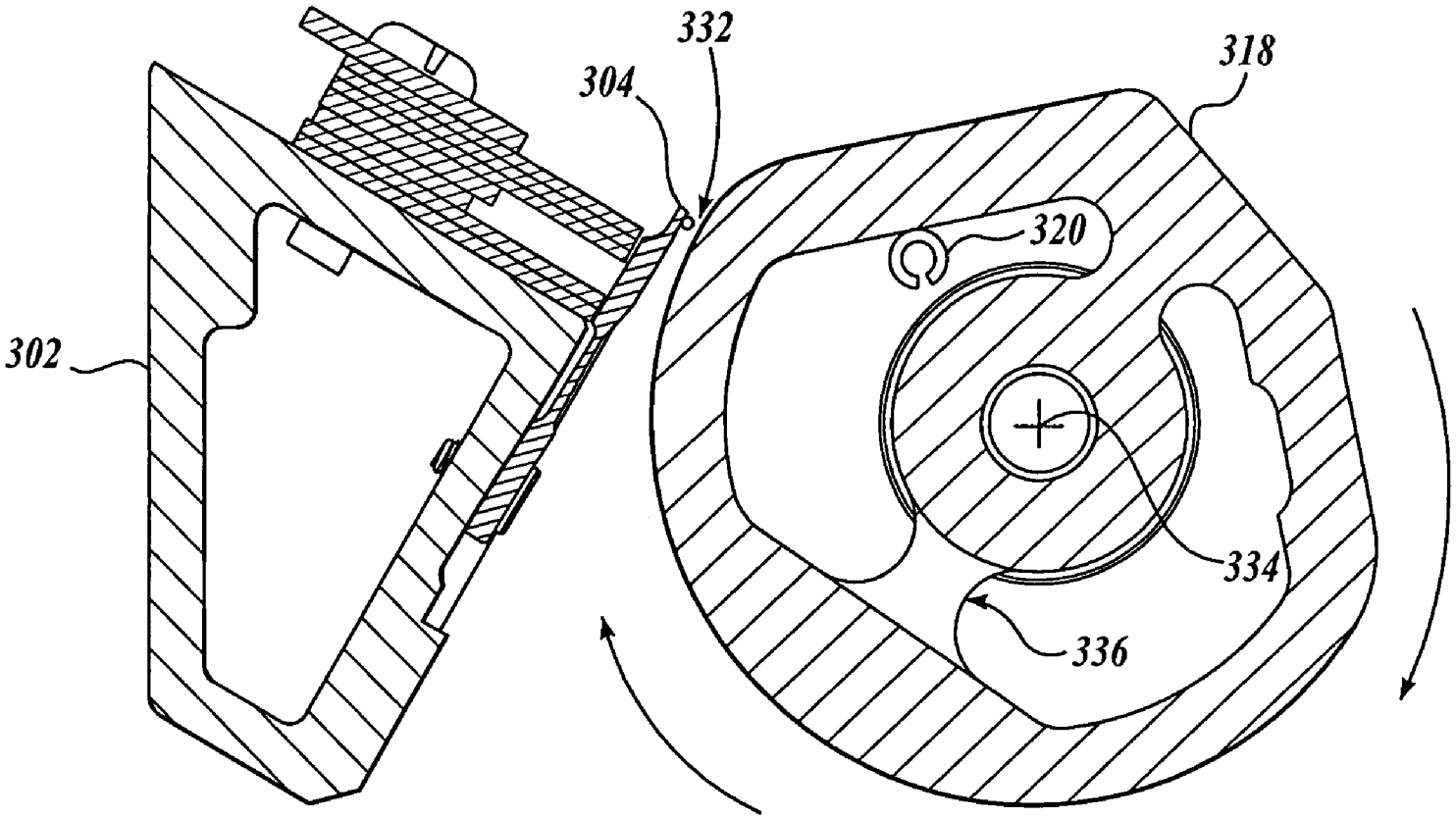
FIG. 5 is a cross-sectional illustration of a hammer bank and platen assembly.
Figure 24:
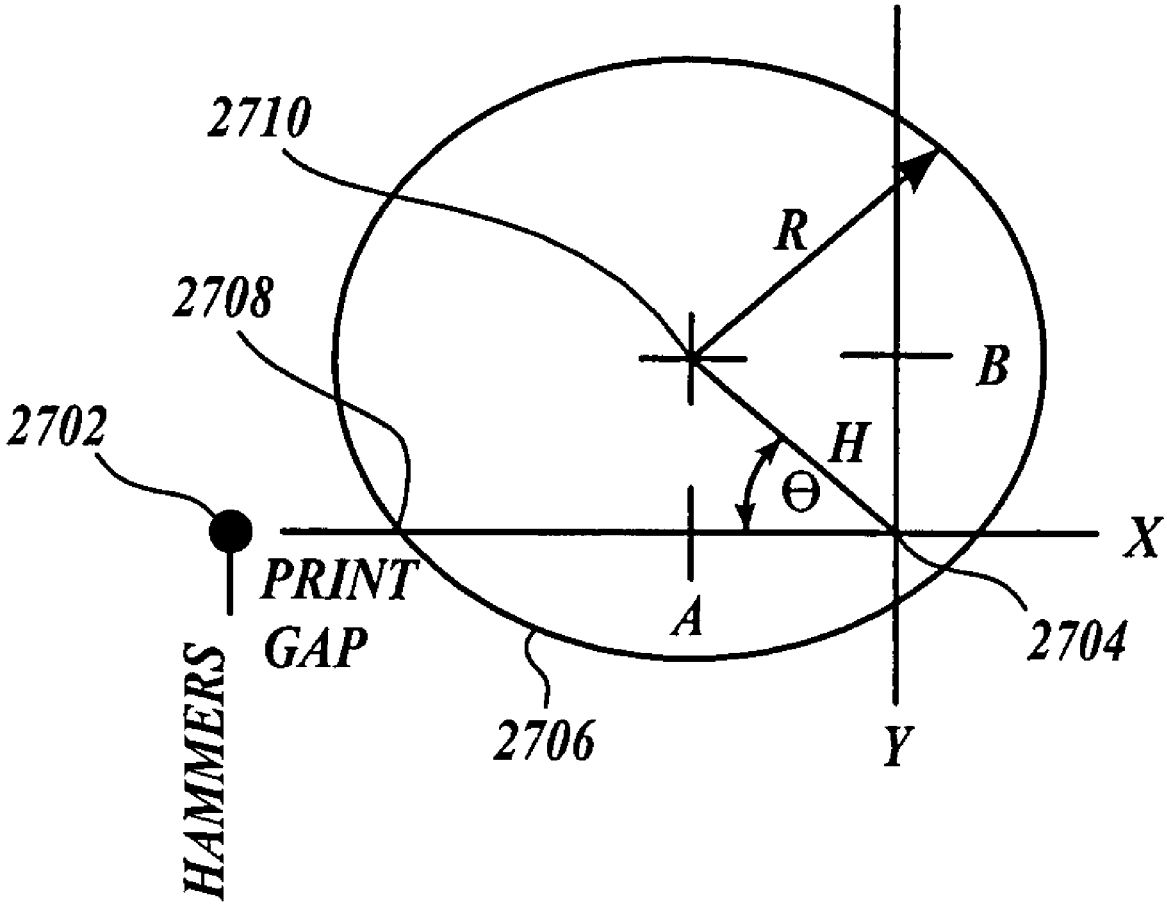
FIG. 24 is a graphical illustration of a method for determining the eccentric platen surface.

Referring to FIGS. 4 and 5, the platen 318 has a center of rotation 334 at the axle (not shown). The platen 318 has an arcuate surface 326 from point 328 to point 330. The platen 318 includes flat portions defined between points 328 and 330 opposite to the arcuate surface 326. Momentarily referring to FIG. 24, one embodiment of the arcuate portion 326 of the platen 318 could be a portion of the circle 2706 having a center of rotation 2704 offset from the center of the circle. The arcuate portion 326 of the platen 318 is defined by the following equation (2):

$$X^2+2XH\cos\Theta+(H\cos\Theta)^2+(-H\sin\Theta)^2-R^2=0 \qquad \text{(Eq. 2)}$$

wherein,

X is the distance from the center of rotation 2704 to the outer surface 2708 along the X axis, i.e., aligned with the hammers 2702;

H is the distance from the center of rotation 2704 to the center 2710 of the circle 2706; and R is the radius of the circle 2706.

In one embodiment, the arcuate surface 326 of the platen 318 is a sector of a circle, however other embodiments of the surface 326 could be other continuous curves. The equation defining the curve, therefore, should not be limited to Equation 2. The equation defining the surface 326 would change based on the actual curve of the platen surface that is selected or available.

Returning to FIGS. 4 and 5, the platen 318 includes hollow cavities. The stop pin 320 travels within the hollow cavities. In FIG. 4, the stop pin 320 is abutting against a notch 324 within the inside surface of the cavity. At this point, the platen 318 cannot be rotated further in the clockwise direction. The platen 318 can only travel in a counterclockwise direction as indicated by the arrows. The impact hammer 304 and the surface of the platen 318 are at the greatest print gap distance 332, although this may not be a printable area of the platen 318. This position may be referred to as the fully open position. In this position, paper (not shown) may be easily loaded into the printer. The stepper motor 308 is used to rotate the platen 318 about the center of rotation 334.

Referring now to FIG. 5, the platen 318 has rotated fully in the counterclockwise direction from FIG. 4, and has now stopped at the other limit of travel. A cutout 336 allows stop pin 320 to pass through unhindered. Platen 318 rotation has been stopped by the stop pin 320 hitting the inside wall of a cavity. At this point, the platen 318 cannot travel further in the counterclockwise direction and is limited to traveling in the clockwise direction as indicated by the arrows. At this point, the impact hammer 304 is at the closest print gap distance 332 from the surface of the platen 318. This position may be referred to as the fully closed position. As can be appreciated from comparing FIGS. 4 and 5, the center of rotation 334 of the platen 318 does not change laterally in space, but the surface of the platen 318 is such that rotation causes a change in the print gap distance 332 between the impact hammer 304 and the surface of the platen 318 as the platen 318 is rotated. Rotation of the eccentric platen 318 provides a way of adjusting the print gap 332 without translation of the print head 302 or platen 318.

To set up for and enable automatically setting a print gap with the eccentric platen 318, stepper motor 308, and sensor 310, a number of relationships are determined beforehand. For paper thickness or crush point detection and optimal print gap setting, calibration procedures are performed in advance. A sensor 310 calibration procedure includes recording the sensor 310 reading for each of the half-step motor positions. When this procedure is run, the platen 318 is first driven to the fully open position (FIG. 4). The stop pin 320 that physically restricts platen 318 rotation defines this position. The printer can determine when this point has been reached by monitoring the sensor 310 reading and performing calculations. Each time the stepper motor 308 is commanded to move a half-step towards fully open, a reading of the sensor 310 is taken. The difference between the reading after the command and the previous reading is then recorded. A running record of the differences can be taken. The last four differences are then summed, for example. If the sum is less than half the expected value, for example, the system may assume that the platen 318 has reached the fully open position. The platen 318 is then backed away from this position by four half-steps, for example. This assures that the platen 318 is not resting against the stop pin 320. The platen 318 will then step through all individual half-steps towards the fully closed position (FIG. 5) and a sensor 310 reading is recorded for each half-step. A database or "look-up" table of sensor 310 reading versus motor step can be produced in this manner. Once this sensor 310 calibration has been completed, the platen 318 may rotate back to the fully open position. This calibration procedure may be run during final printer assembly or whenever the platen 318 is replaced.

A second calibration procedure correlates the print gap distance to motor half-steps. When this procedure is run, the stepper motor 308 may be moved to half-step 54, for example. At this time, the print gap is adjusted to be 13 mils (0.013 inches). The print gap of 13 mils is chosen such that the printer is able to detect and print on the widest range of forms. This may be accomplished by using a shim and turning the adjust screws on the platen 318 adjust plates 306. Once this calibration procedure has been completed, the print gap for every half-step position is known. A database or "look-up" table of print gap distance 332 versus motor half-step can be produced. This second calibration procedure may be run during final printer assembly or whenever the platen 318 or hammer bank 302 is replaced. It is to be understood that the stepper motor step of "54," set to correspond to a print gap of 13 mils, is merely for illustration purposes and is not intended to limit the invention.

Figure 6:
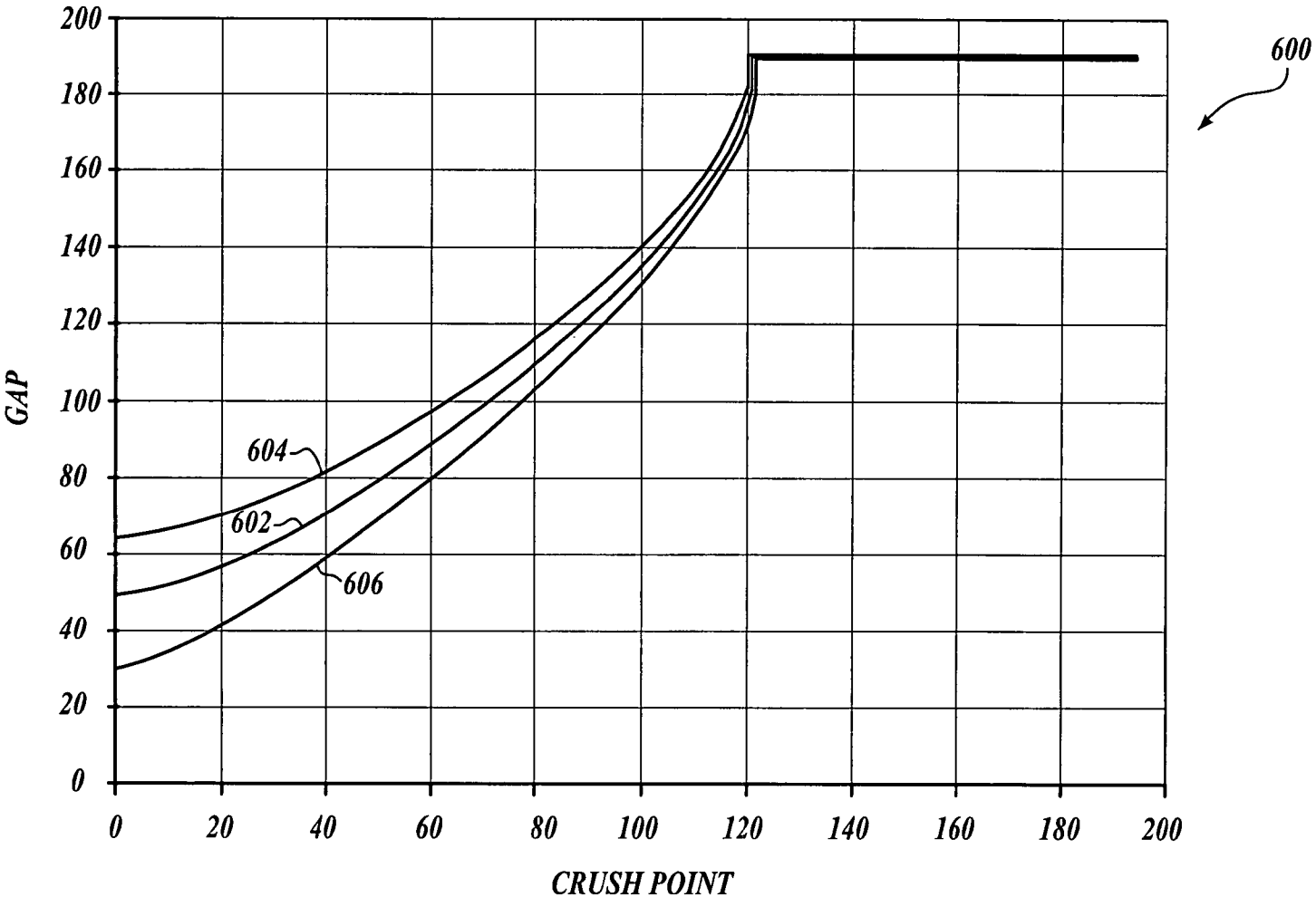
FIG. 6 is a graphical illustration of the optimal print gap measured in motor steps versus the crush point measured in motor steps for a representative printer.

FIG. 6 is a representative plot 600 of the optimal print gap 332, measured in motor steps versus crush point, also measured in motor steps. The plot shows the optimal print gap setting line 602 with upper 604 and lower 606 adjustment limits. The plot 600 can be saved electronically as an array of values or as an equation in a printer computer's memory, so that when the crush point is known, the print gap setting, as measured in motor steps (for a particular motor), can be determined. The stepper motor 308 can then be commanded to the desired print gap by inputting the motor step on the "y" axis corresponding to a crush point "x" value that has been measured.

Figure 7:
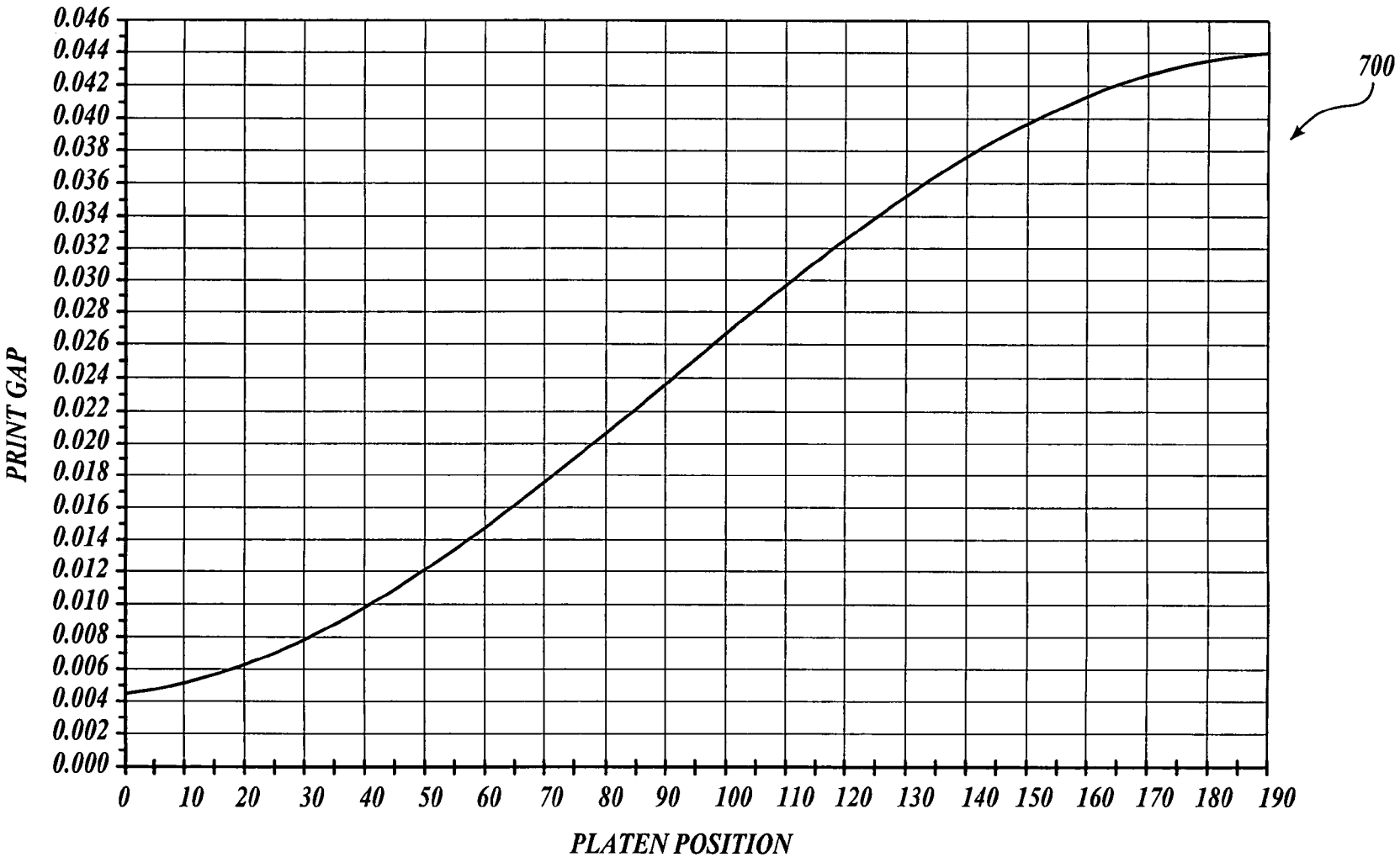
FIG. 7 is a graphical illustration of the print gap in inches versus platen position in motor steps for a representative printer.

FIG. 7, by way of comparison with FIG. 6, is a representative plot 700 of the actual print gap as measured by units of distance versus the stepper motor 308 step position.

Figure 8:
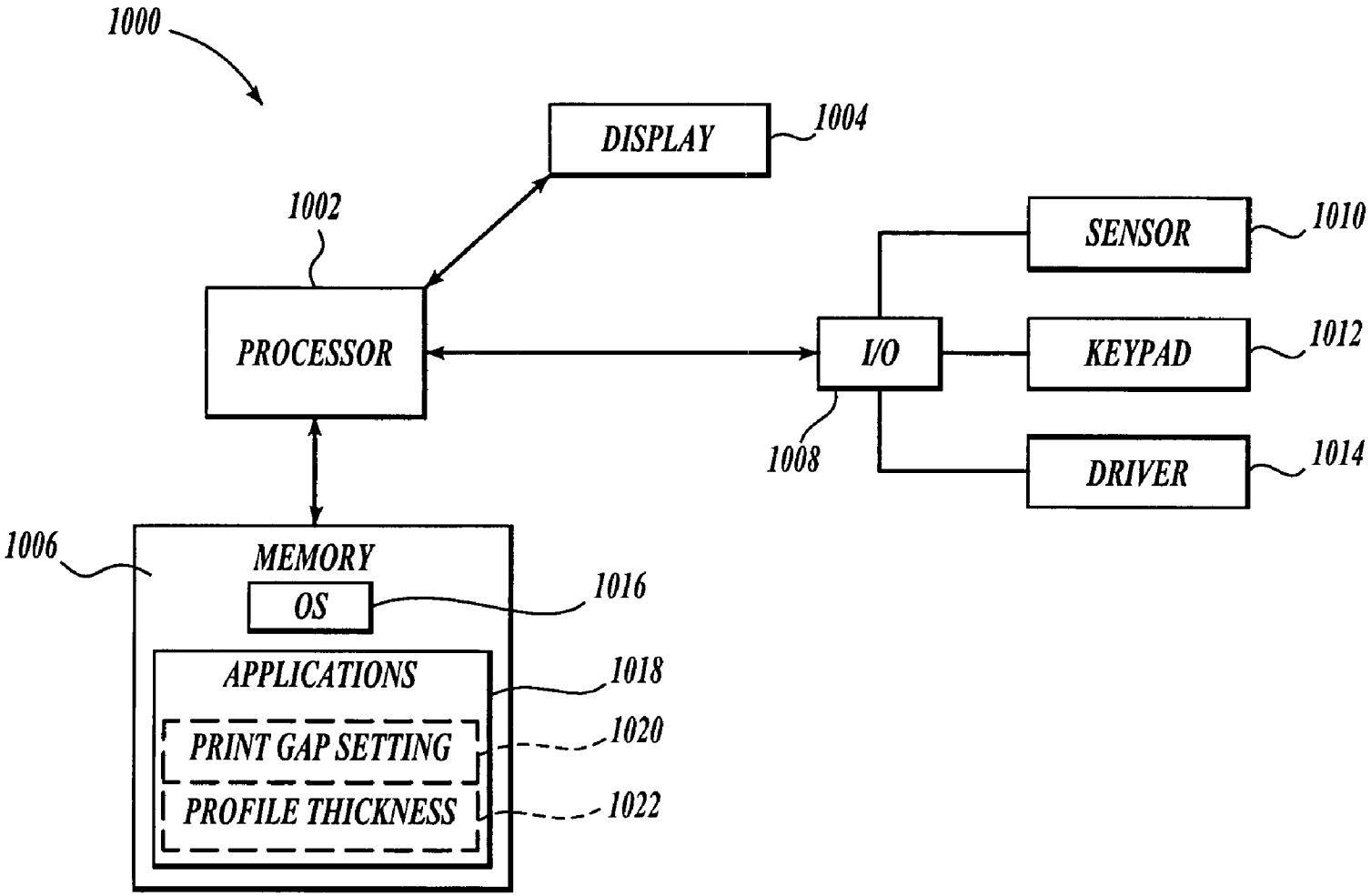
FIG. 8 is a schematic illustration of a computer system for a printer.

Referring now to FIG. 8, a block diagram of a computer system 1000 of a printer is provided. In addition to the elements of the printer assembly shown in FIGS. 2-5, the printer includes the computer system 1000. The computer system 1000 may include a processor 1002, a display 1004, a memory 1006, and an input/output system 1008. The input/output system 1008 contains instructions for communicating with peripheral components, including sensor 1010 (sensor 310 in FIG. 2), keypad 1012, and driver 1014 (motor 308 in FIG. 2). The processor 1002 receives user instructions or commands from a user interface, such as the keypad 1012. In response thereto, the processor 1002 communicates with and/or controls the driver 1014. Additionally, the processor 1002 may communicate with and receive data from the sensor 1010. In addition, the processor 1002 may also send information and instructions to the user via the display 1004. Instructions from the user may include to calibrate the sensor to the stepper motor, to determine the print gap setting, and to profile the thicknesses of a printing medium. The processor 1002, based upon the user's instructions and with additional inputs, such as from the sensor 1010, issues commands to the driver 1014. The actions of the processor 1002 are governed by a series of computer-executable instructions, examples of which are described in detail below. The processor 1002 may be connected to various other system components via a local bus system. The computer system 1000 may also include memory 1006. Memory 1006 may be read-only memory (ROM) and random access memory (RAM). A number of program modules may be stored in memory 1006. Program modules may include the operating system module 1016 and an applications module 1018. Within the applications module 1018, a print gap setting module 1020 and a thickness profile module 1022 are provided. Print gap setting module 1020 may contain algorithms, databases, data structures, program modules, and other data and instructions for processing by the processor 1002 to implement a print gap setting method. The thickness profile module 1022 may include algorithms, databases, data structures, program modules, and other data and instructions for the processor 1002 to implement a thickness profile method. Input/output devices 1010, 1012, and 1014 may be connected to the processor 1002 through various interfaces.

Figure 9:
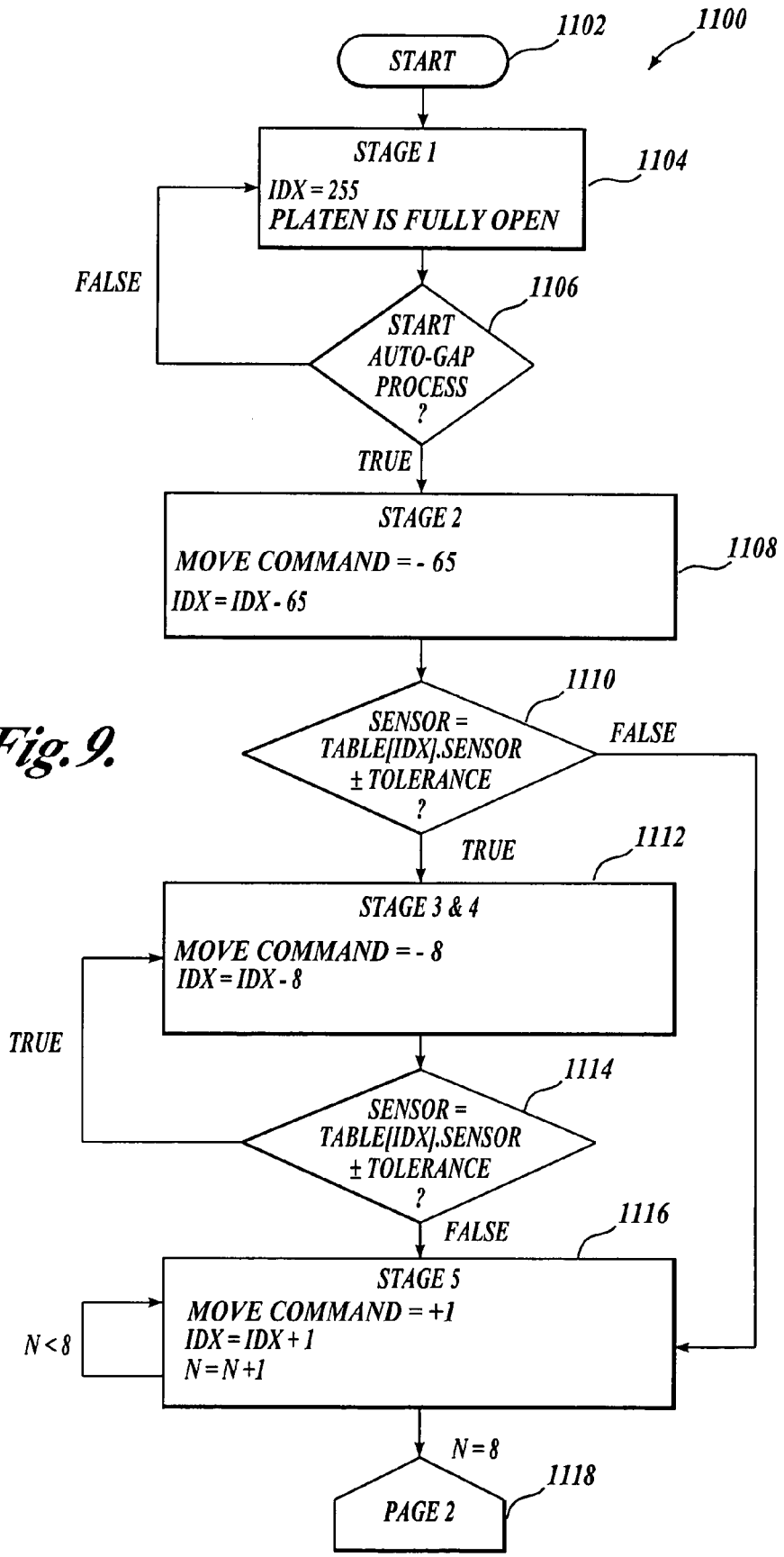
FIG. 9 is a flow diagram of a method for setting the print gap of a printer.
Figure 11:
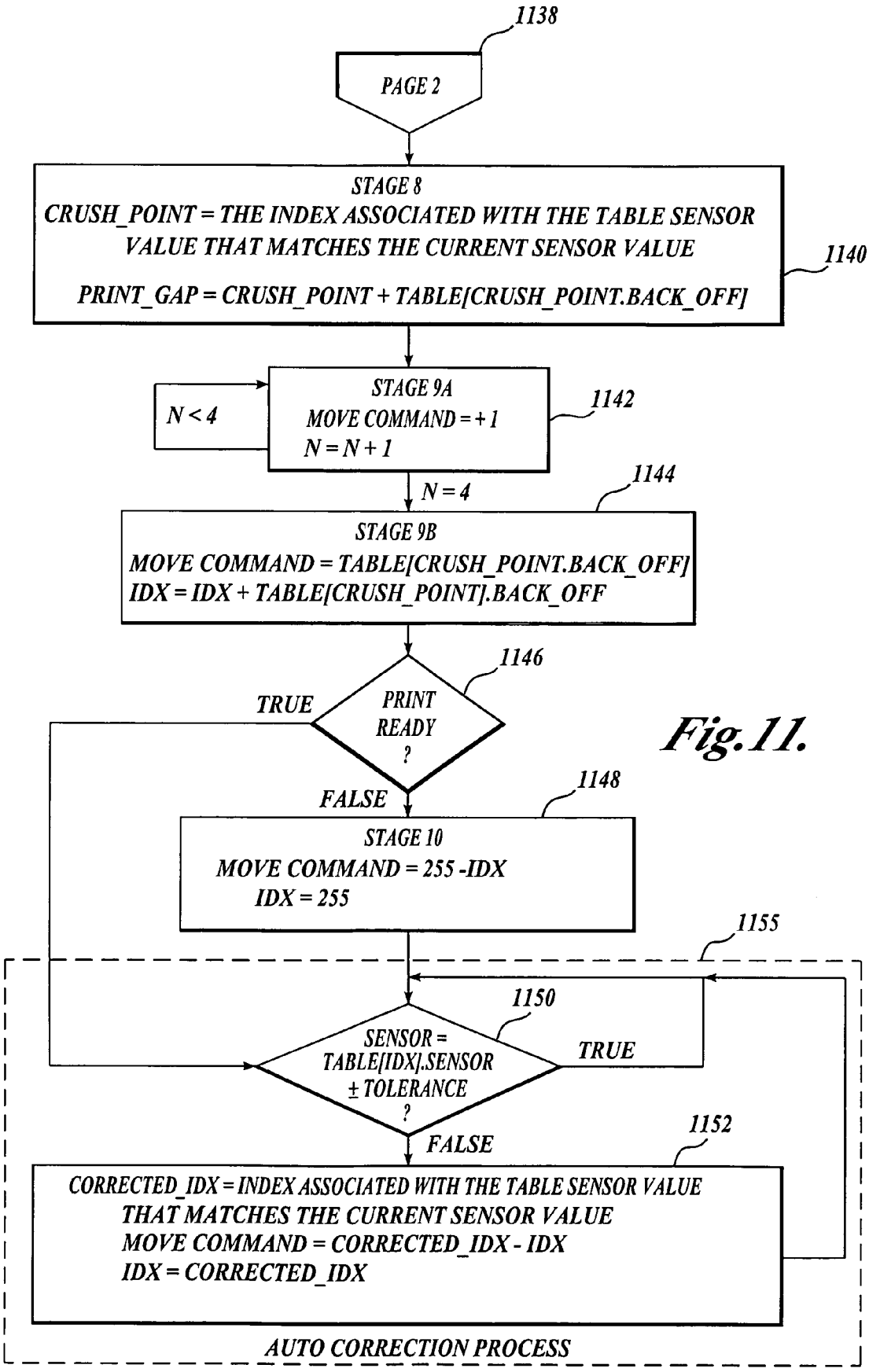
FIG. 11 is a flow diagram of a method for setting the print gap of a printer.
Figure 12:
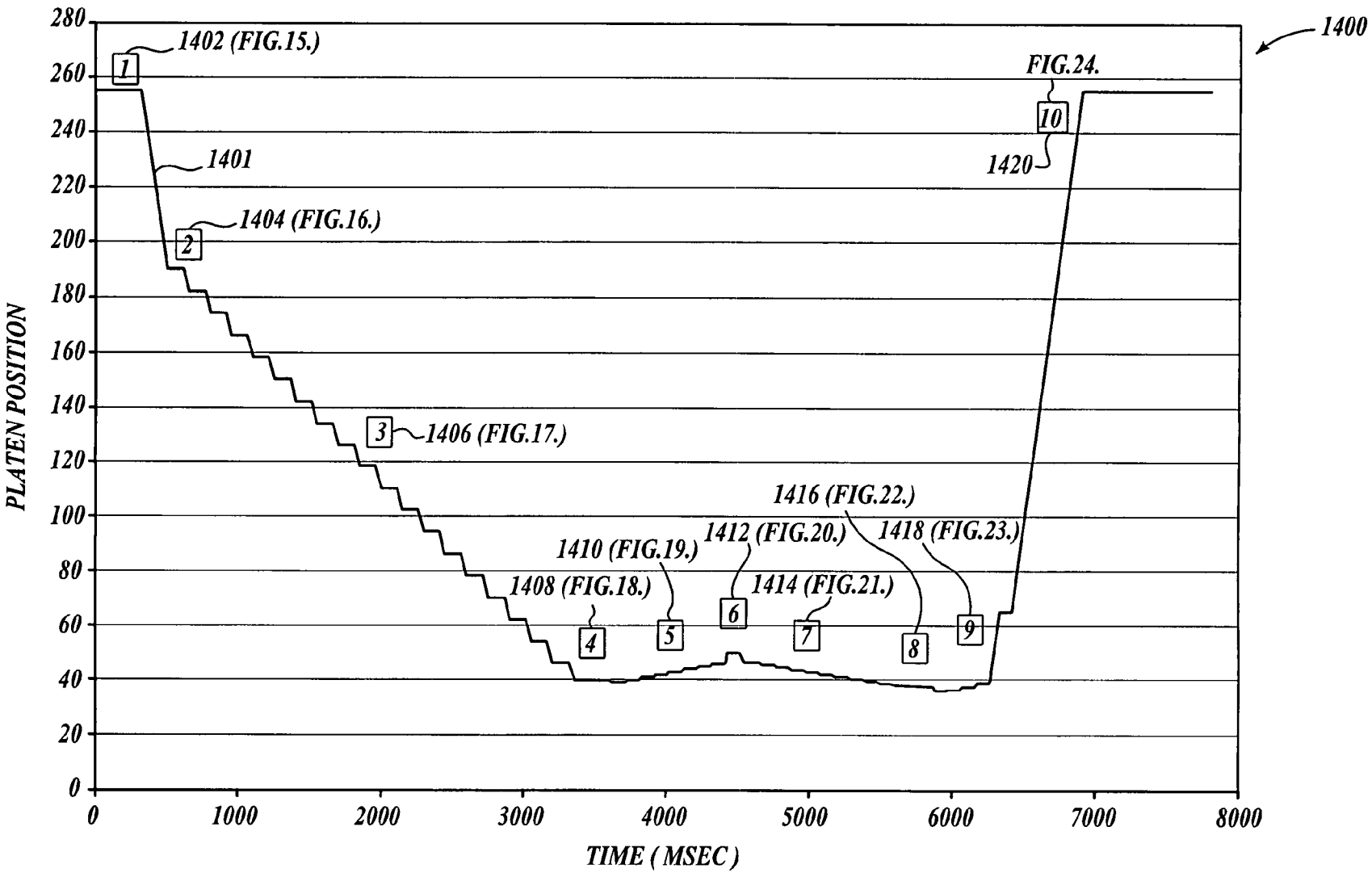
FIG. 12 is a graphical illustration of the platen position measured in motor steps versus time in milliseconds for a print gap setting method.

Referring now to FIGS. 9-22, a print gap setting method 1100 for a printer is described. FIGS. 9-11 are flow diagrams of the method. FIG. 12 is the overall method shown as a plot of the platen position (as input by motor step) versus time, in milliseconds. FIGS. 13-22 are plots of individual stages of the method that correspond with FIG. 12. The following is a description of the method 1100 including determining a crush point, followed by setting the print gap based on the determined crush point through a series of stepper motor commands and sensor readings. The method 1100 also describes a series of stepper motor commands that drive the platen 318 into the paper 316 and impact hammers 304 in order to determine the crush point based on stepper motor 308 input. A first series of commands drive the platen in large increments followed by a series of commands that drive the platen 318 in smaller increments for an accurate determination of the paper thickness.

Referring to FIGS. 9-11, method 1100 begins at the start block 1102. From start block 1102, method 1100 may enter stage 1, block 1104. At stage 1, block 1104, the platen 318 is at the fully open position. The platen 318 position variable, IDX, is the stepper motor 308 commanded step. Each time the motor 308 is commanded to a new step, the variable IDX is set to the commanded step. The values of all possible IDX values may be stored in a control table (Table 1) with various other parameters.

TABLE 1

CONTROL TABLE

| IDX Value (half-steps) | Sensor Value (from calibration) | Back-off Value | Adjust Value |
|---|---|---|---|
| 1 | $SV_1$ | $BOV_1$ | $AV_1$ |
| 2 | $SV_2$ | $BOV_2$ | $AV_2$ |
| 3 | $SV_3$ | $BOV_3$ | $AV_3$ |
| 4 | $SV_4$ | $BOV_4$ | $AV_4$ |
| . . . | . . . | . . . | . . . |
| 255 | $SV_{255}$ | $BOV_{255}$ | $AV_{255}$ |

The control table may have a corresponding sensor value, the number of "back-off" steps, and the number of "adjust" steps for each value of IDX. Each value of IDX in the control table corresponds to the motor steps 0 through 255, and each value of IDX is paired with the sensor value obtained through the sensor calibration procedure, the back-off value, and the adjust value. The sensor value of the control table is used to compare with the actual sensor 310 reading to verify that the motor 308 rotor has reached the commanded position. Because the platen 318 may be directly coupled to the rotor, the platen 318 position may be assumed from the motor step. The back-off value is a value that when added to the crush point value, defines the optimal print gap for the currently loaded paper in terms of motor steps. The crush point is determined via method 1100, and the optimal print gap is predetermined, for example, from FIG. 6. The adjust value contains the allowable range for the print gap. Thus, referring to FIG. 6, the adjust value is the absolute value of the difference between curve 602 and curve 604 or curve 606. When a sensor 310 reading is compared against the sensor value, an exact match is not required. The method 1100 adjusts for this with a tolerance factor within the comparison algorithm.

Figure 13:
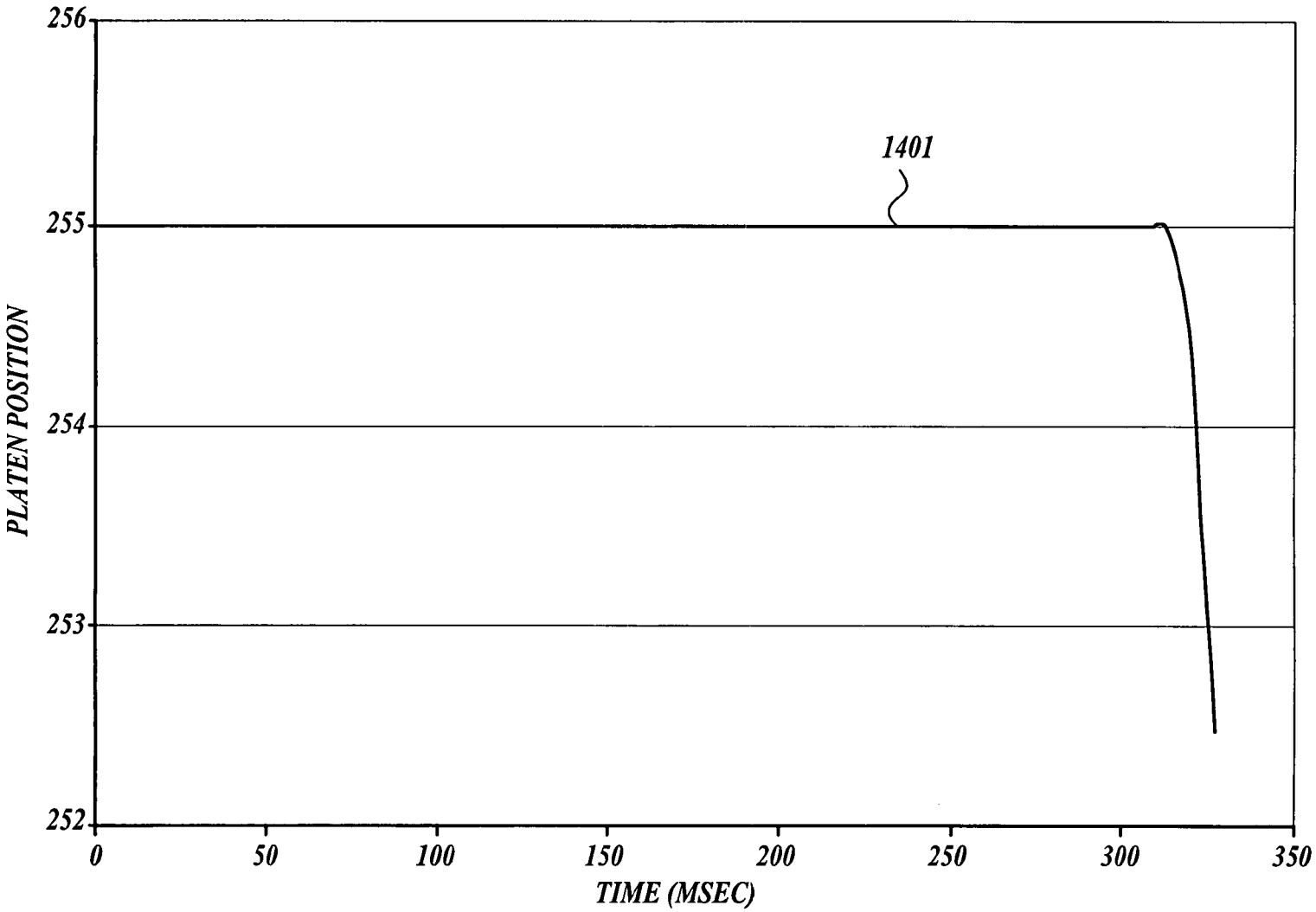
FIG. 13 is a graphical illustration of the platen position measured in motor steps versus time in milliseconds for a print gap setting method.

In FIG. 12, stage 1 is illustrated at location 1402 in the overall plot 1400 of the method 1100. The continuous line 1401 represents the commanded motor step throughout the method 1100. In FIG. 13, the line 1401 indicates that the platen 318 is commanded to the fully open position and waiting for a command of the stepper motor 308. Fully open is defined as step position 255 for this embodiment. At the fully open position, the print gap distance 332 is at its widest.

Returning to FIG. 11, from block 1104, the method 1100 may enter decision block 1106. At decision block 1106, the method 1100 determines whether a command has been issued to initiate the automatic setting of the print gap. If the determination in decision block 1106 is FALSE, the method 1100 remains at stage 1, block 1104. However, if the determination in decision block 1106 is TRUE, the method 1100 moves into stage 2, block 1108.

Figure 14:
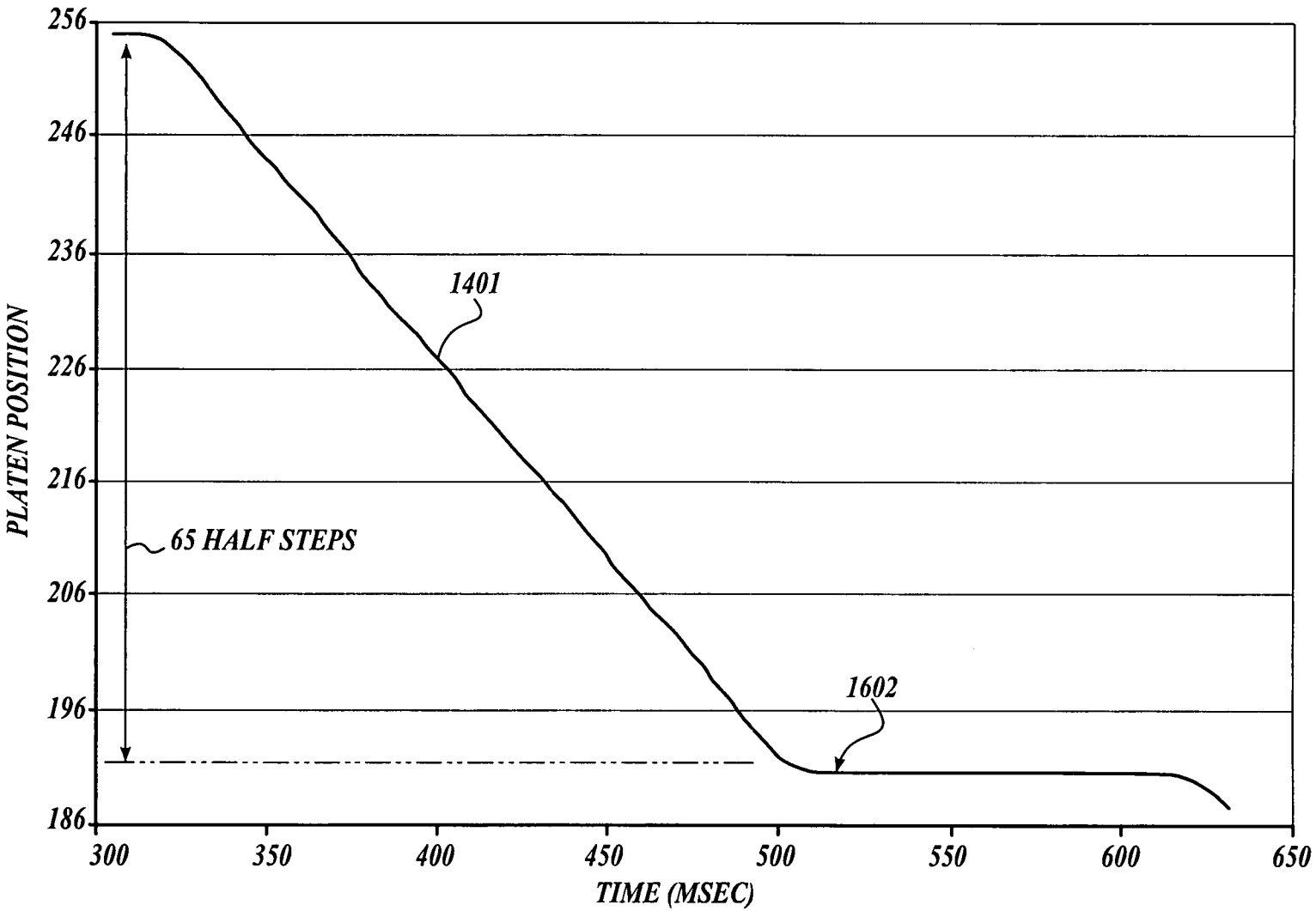
FIG. 14 is a graphical illustration of the platen position measured in motor steps versus time in milliseconds for a print gap setting method.

In block 1108, the platen 318 is commanded to move 65 steps towards the fully closed position. In block 1108, the variable IDX may be set equal to the IDX value in block 1104 minus 65 steps. In FIG. 12, stage 2 is indicated by location 1404. The line 1401 is shown to have a negative slope. In FIG. 14, the slope of line 1401 indicates the platen 318 has been commanded to close the print gap 332. The motor 308 is commanded to step 190 corresponding to location 1602. This equates to a move distance of 65 half-steps from step 255. Step 190 may be the beginning of the printable area of the platen 318, i.e., the arcuate portion of the platen 318 defined between location 328 and 330 (FIG. 4).

Referring to FIG. 9, from block 1108, the method 1100 may enter decision block 1110. At decision block 1110, a determination is made whether the sensor 310 reading is equivalent to the sensor value from the control table corresponding to the IDX value of 190 within a tolerance factor. If the determination in decision block 1100 is FALSE, the method 1100 may enter stage 5, block 1116. Entering stage 5, block 1116, signifies that the platen 318 has encountered the paper 316 or some other obstruction that causes the sensor 310 reading not to match the sensor value of the control. However, if the determination in decision block 1110 is TRUE, the method 1110 may enter stages 3 and 4, block 1112. Stages 3 and 4 are for moving the platen 318 in large increments towards the paper 316.

In block 1112, the platen 318 is commanded to move in large increments of eight half-steps towards fully closed. The variable IDX is set equal to the IDX value in stage 2, block 1108, minus eight half-steps after each motor 308 command.

Figure 15:
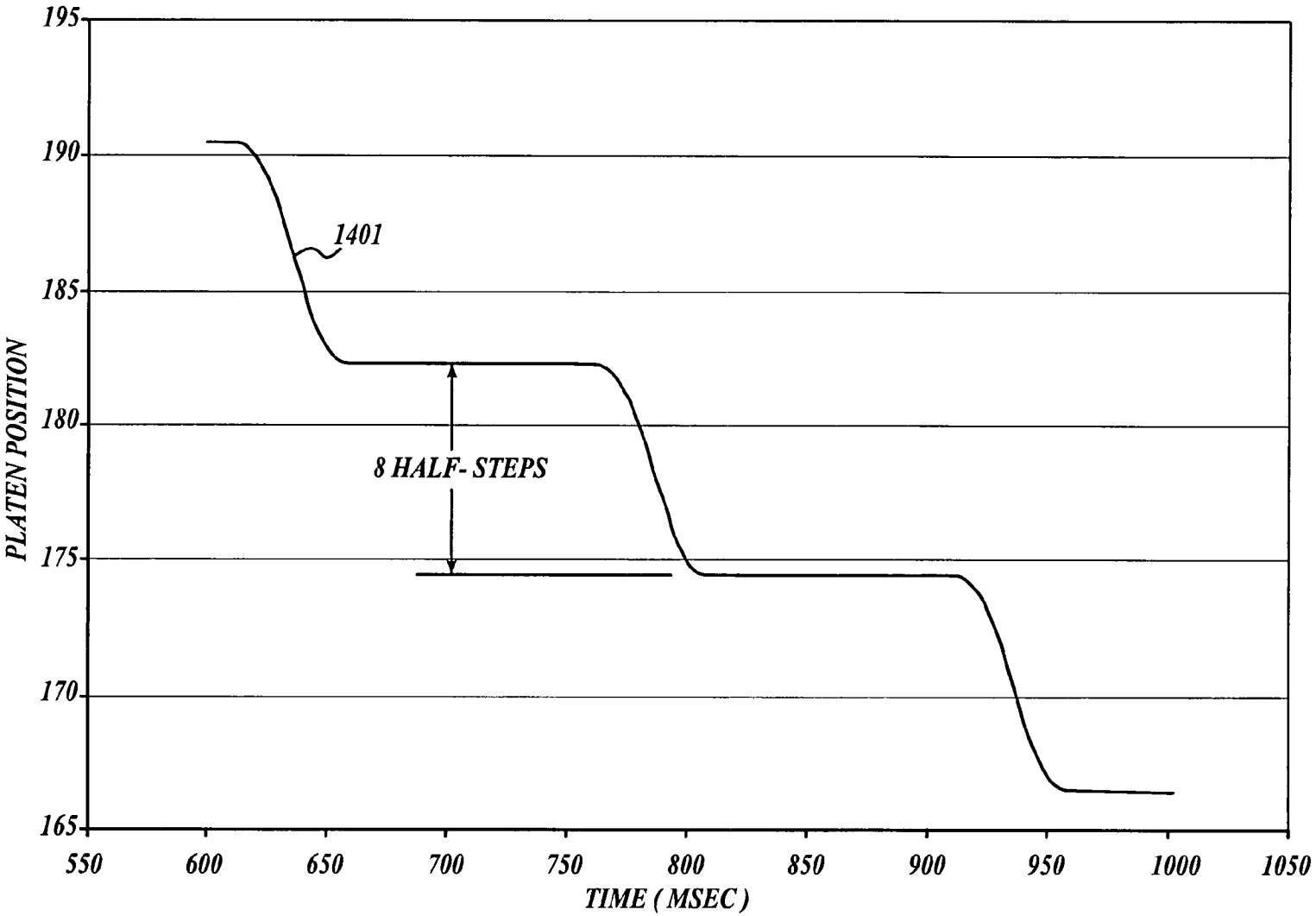
FIG. 15 is a graphical illustration of the platen position measured in motor steps versus time in milliseconds for a print gap setting method.

In FIG. 12, stage 3 is represented by location 1406. The line 1401 is shown as a series of discrete increments towards motor step zero (0), i.e., the fully closed position. In FIG. 15, from line 1401, the reduction in the motor step in increments of eight half-steps can be seen. After each move of eight half-steps, the sensor 310 reading is compared to the sensor value stored in the control table corresponding to the IDX variable for the step. This continues until the sensor 310 reading and the sensor value from the control table fail to match. This indicates that the platen 318 is unable to reach the commanded position. Moves of eight half-steps are chosen to minimize the time it takes to bring the platen 318 in contact with the paper 316. Increments of eight (8) half-steps are desirable because it equates to one electrical revolution of the particular stepper motor 308 being described.

Referring to FIG. 9, from block 1112, the method 1100 may enter decision block 1114. At decision block 1114, the method 1100 determines whether the sensor 310 reading is within the tolerance factor of what the control table indicates the sensor 310 reading should be for the commanded step. As long as the determination in decision block 1114 is TRUE, the method 1100 continues to command the stepper motor 308 to move in increments of eight half-steps towards the fully closed position. When the determination in decision block 1114 is FALSE, i.e., when the sensor 310 reading does not match the sensor value for the commanded step IDX value from the control table by more than the tolerance factor, the method 1100 is at stage 4, and may enter stage 5, block 1116.

Figure 16:
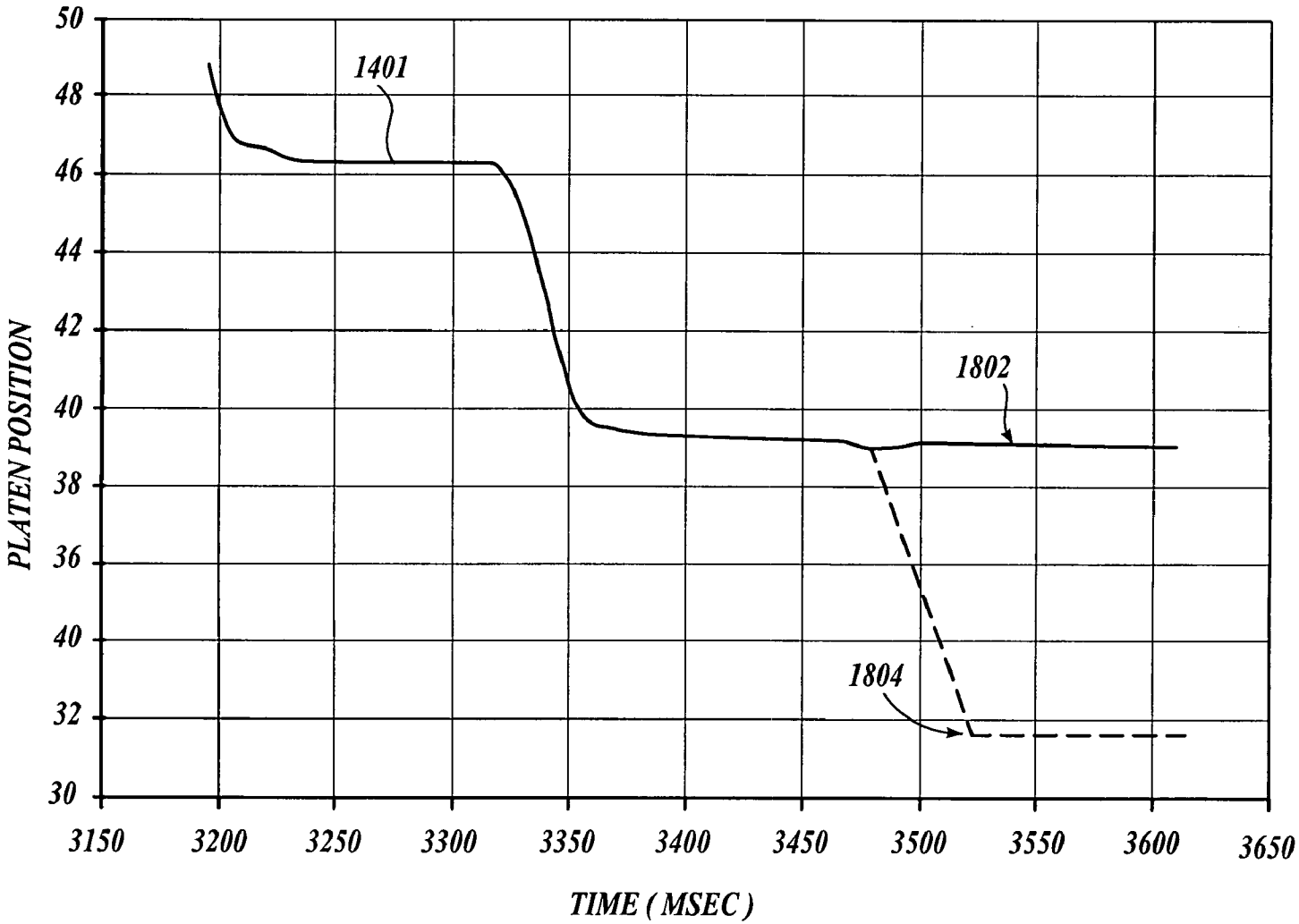
FIG. 16 is a graphical illustration of the platen position measured in motor steps versus time in milliseconds for a print gap setting method.

In FIG. 12, stage 4 is at location 1408. Line 1401 is shown to be approximately flat when the sensor 310 reading fails to match the sensor value from the control table corresponding to the commanded step. In FIG. 16, at stage 4, the motor 308 is unable to move the platen 318 to the commanded step position. In this example, the previous move finished just as the platen 318 was brought in contact with the paper 316. When the next move of eight half-steps is commanded, the motor 308 stalls, and the sensor 310 reading essentially does not change from the previous reading. This is detected by comparing the current sensor 310 reading to the sensor value stored in the control table for the commanded motor position IDX value. Since the values do not match to within the tolerance factor, the method 1100 assumes that the motor 308 has stalled. The line 1401 at location 1802 indicates where the motor 308 stalled and the sensor 310 reading remains substantially the same. The dashed line 1804 indicates where the motor 308 and sensor 310 reading would have been had the motor 308 not been stalled by the paper 316.

Referring to FIG. 9, as previously described, stage 5, block 1116, may be entered from block 1114, and block 1116 may also be entered from decision block 1110. At stage 5, block 1116, the motor 308 rotor may lose synchronization with the electrical step position, as determined by the sensor 310 reading not matching a sensor value. In stage 5, the motor 308 may be commanded to reverse direction to regain synchronization. If the sensor value does not match the sensor 310 reading, it can be assumed that the motor 308 is a multiple of eight half-steps away from the commanded position. This is due to there being eight half-steps per electrical revolution of the particular stepper motor 308. Therefore, only the control table sensor values stored at multiples of eight locations away from the commanded position may be checked. In stage 5, block 1116, the platen 318 is commanded to move toward fully open. In block 1116, stepper motor 308 commands may be given in increments of one (1) half-step. A counter is incremented for every command of one half-step. As long as the commands total less than eight half-steps, the method 1100 continues to command the stepper motor 308 to move one half-step toward fully open. When the counter indicates that eight half-steps have been commanded, the method 1100 may enter continuation block 1118. Continuation block 1118 links with continuation block 1120 in FIG. 10. From continuation block 1120 in FIG. 10, the method 1100 may enter decision block 1122 (FIG. 10).

Figure 17:
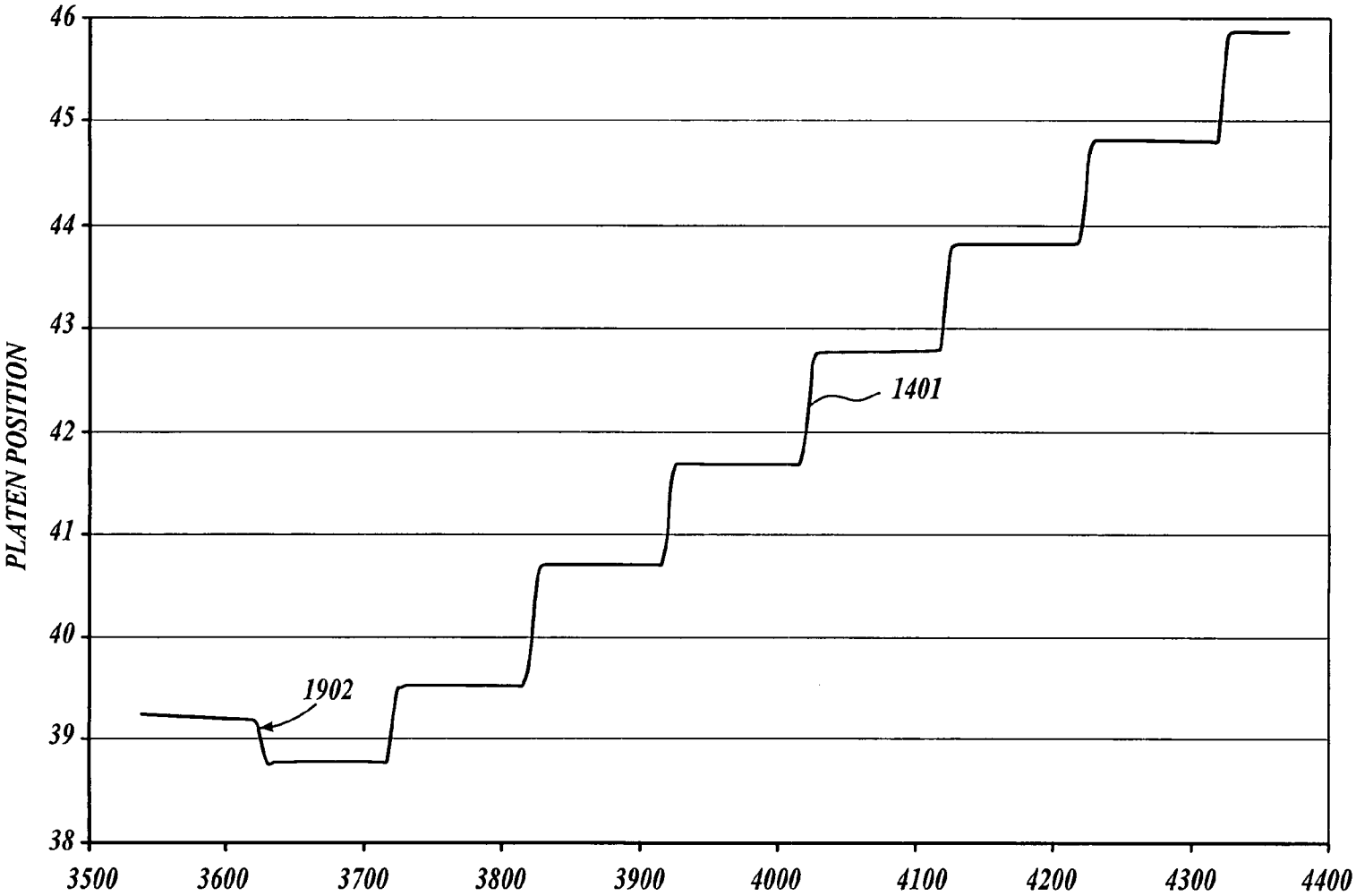
FIG. 17 is a graphical illustration of the platen position measured in motor steps versus time in milliseconds for a print gap setting method.

In FIG. 12, stage 5 is at location 1410. In FIG. 17, from line 1401, the platen 318 is shown being commanded toward fully open by eight (8) half-step increments. This puts the platen 318 at a position that is not in contact with the paper 316. Single half-steps may be used because the previous move of eight half-steps, during stages 3 and 4, may have left the platen 318 in an unstable state, meaning that the stepper motor 308 rotor may be out of synchronization with the electrical step position. The single steps may make sure that the stepper motor 308 rotor is synchronized back with the energized windings. Platen movements towards the fully open position may also generate more torque. This may be accomplished by increasing the drive current to the motor 308. By stepping the platen 318 into the paper 316 with a lower torque than stepping away from the paper, the platen 318 should never get stuck. In the illustrated example, the first single half-step 1902 reduces the print gap 332 even further instead of increasing it. This may occur when the previous move leaves the stepper motor 308 rotor lagging the actual electrical step position. In this example, the rotor was lagging by approximately two half-steps. The first move toward fully open brings the electrical step position to within one half-step of the rotor position and the rotor is then pulled to this position.

Referring to FIG. 10, in decision block 1122, a determination is made whether the sensor 310 reading is equal to the sensor value from the control table for the commanded step to within the tolerance factor. If the determination in decision block 1122 is FALSE, the method 1100 sets the variable IDX equal to the previous IDX value plus eight half-steps. This is stage 6A, block 1124. If the determination in decision block 1122 is TRUE, the method 1100 enters stage 6B, block 1126. Stage 6B represents a biasing command. In block 1126, the stepper motor 308 is commanded to move four (4) half-steps towards the fully opened position. The variable IDX is the previous IDX value plus four. The stepper motor 308 is then commanded to move four (4) half-steps towards the fully closed position. The variable IDX is set to the previous IDX value minus four. This is the series of commands that execute the biasing move.

Figure 18:
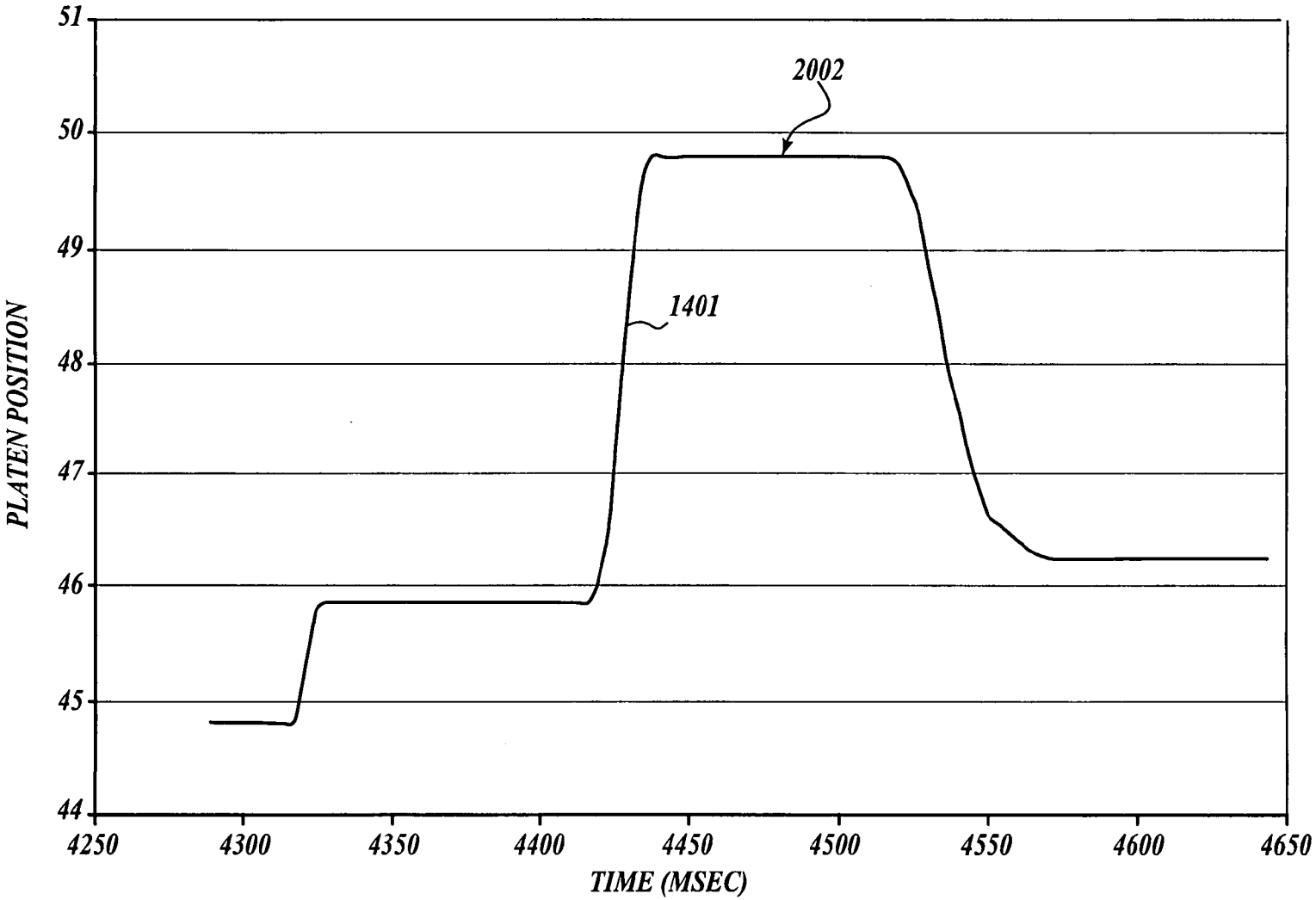
FIG. 18 is a graphical illustration of the platen position measured in motor steps versus time in milliseconds for a print gap setting method.

In FIG. 12, stages 6A and 6B are illustrated at location 1412. In FIG. 18, at stage 6B, before the biasing move, the sensor 310 reading is compared to the sensor values from the control table. The software searches the control table to find the IDX entry that matches the current sensor 310 reading. This entry relates to one of the 255 possible step positions. When the match is found, the IDX variable is updated to the IDX value from the control table matching the sensor 310 reading. The reason for the possible mismatch between the sensor 310 reading and the current step position IDX value is due to the motor stalling. During stalling, the rotor may get out of synchronization from the commanded position by eight half-steps. FIG. 18 illustrates backlash that may exist between the platen 318 and the sensor 310, requiring that a biasing move 2002 be commanded. From line 1401, the biasing move 2002 of four half-steps toward fully open, followed by four half-steps toward fully closed is seen.

From stage 6B, block 1126, the method 1100 may enter stage 7A, block 1128. Stage 7 is composed of three stages that, combined, are for determining, with higher precision, when the platen 318 has made contact with the paper 316. Because of stage 7, the motor 308 may be controlled to consistently apply the same compression force to all paper being measured, irrespective of thickness. To this end, method 1100 may determine when the lead angle reaches 90 degrees, i.e., maximum torque, for example. This motor condition may be determined by summing the differences between successive sensor 310 readings, and when the sum of a plurality of differences is less than a predetermined threshold, it may be assumed that the motor 308 has reached the point of maximum torque, i.e., the crush point, at which point the platen 318 position may be recorded and used for obtaining the corresponding print gap. This series of commands and computations results in applying a similar force to every paper that is measured, regardless of thickness.

Alternatively, the threshold does not need to correspond with the motor 308 point of maximum torque. A compression force that is low enough such that the ink smudging on the paper is minimized may be used.

In block 1128, the stepper motor 308 is commanded to move the platen 318 toward fully closed in four half-step increments. The variable IDX is set to the previous IDX value minus one after every iteration. A difference value is determined by subtracting the current sensor 310 reading after the command from the previous sensor 310 reading before the command and storing the value as a difference value after every command. A counter is incremented by one. As long as the counter value is less than four, the method 1100 continues to command the stepper motor 308 to drive the platen 318 toward fully closed in half-step increments. When the counter reaches four, the method 1100 may enter stage 7B, block 1130. In block 1130, a sum of the four differences is obtained. From block 1130, the method 1100 may enter decision block 1132. In decision block 1132, a determination is made whether the sum is greater than a threshold value. If the determination in decision block 1132 is FALSE, the method 1100 may enter stage 8, block 1140 (FIG. 11) through continuation blocks 1136 and 1138. However, if the determination in decision block 1132 is TRUE, the method 1100 may enter stage 7C, block 1134. At stage 7C, block 1134, the stepper motor 308 is commanded to move the platen 318 toward the fully closed position by one half-step. The variable IDX is set to the previous IDX value minus one. Three of the four difference values are shifted to the succeeding value, and the fourth difference value is set to the previous sensor 310 reading before the command minus the current sensor 310 reading after the command. From block 1134, the method 1100 may return to stage 7B, block 1130.

Figure 19:
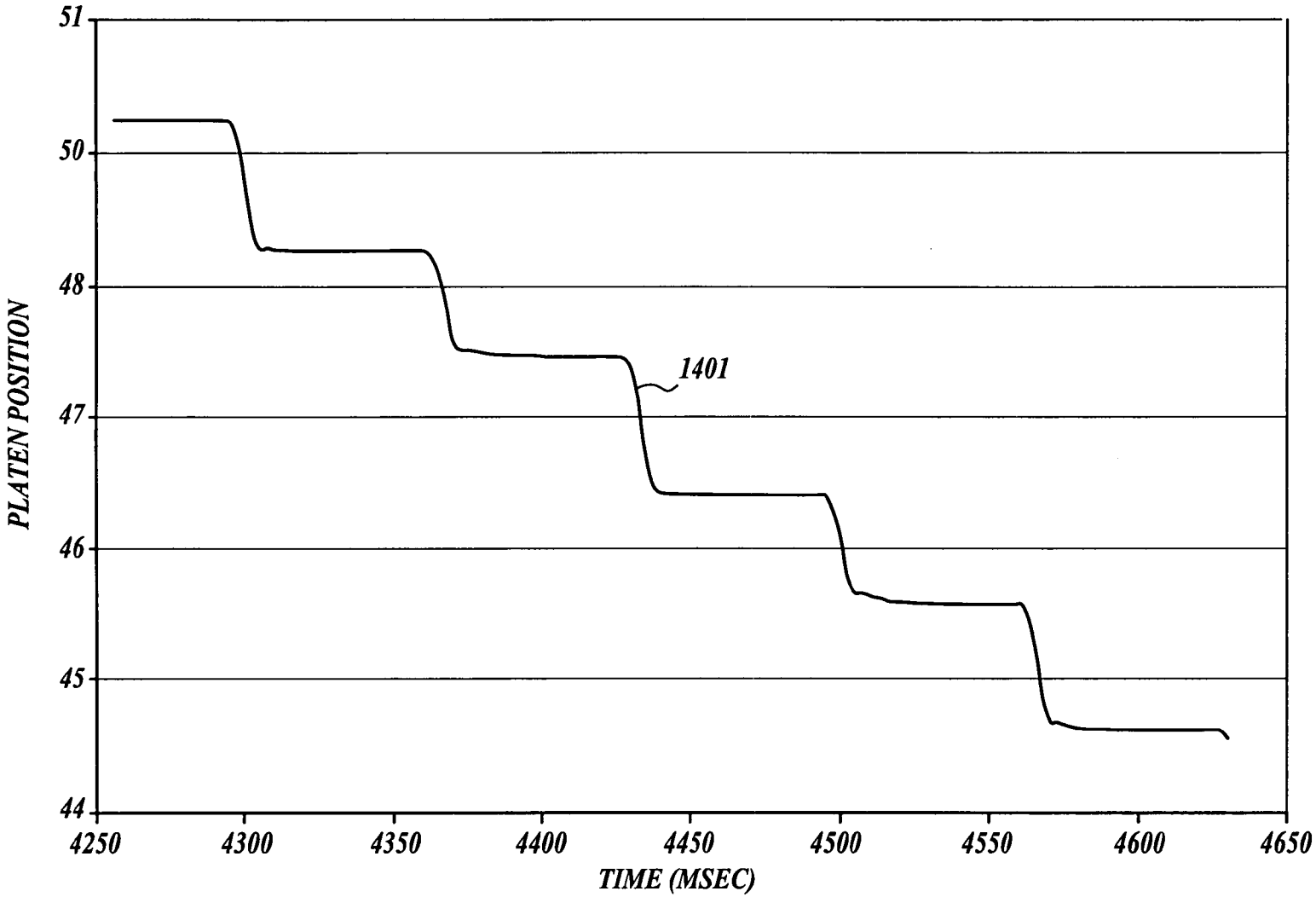
FIG. 19 is a graphical illustration of the platen position measured in motor steps versus time in milliseconds for a print gap setting method.
Figure 20:
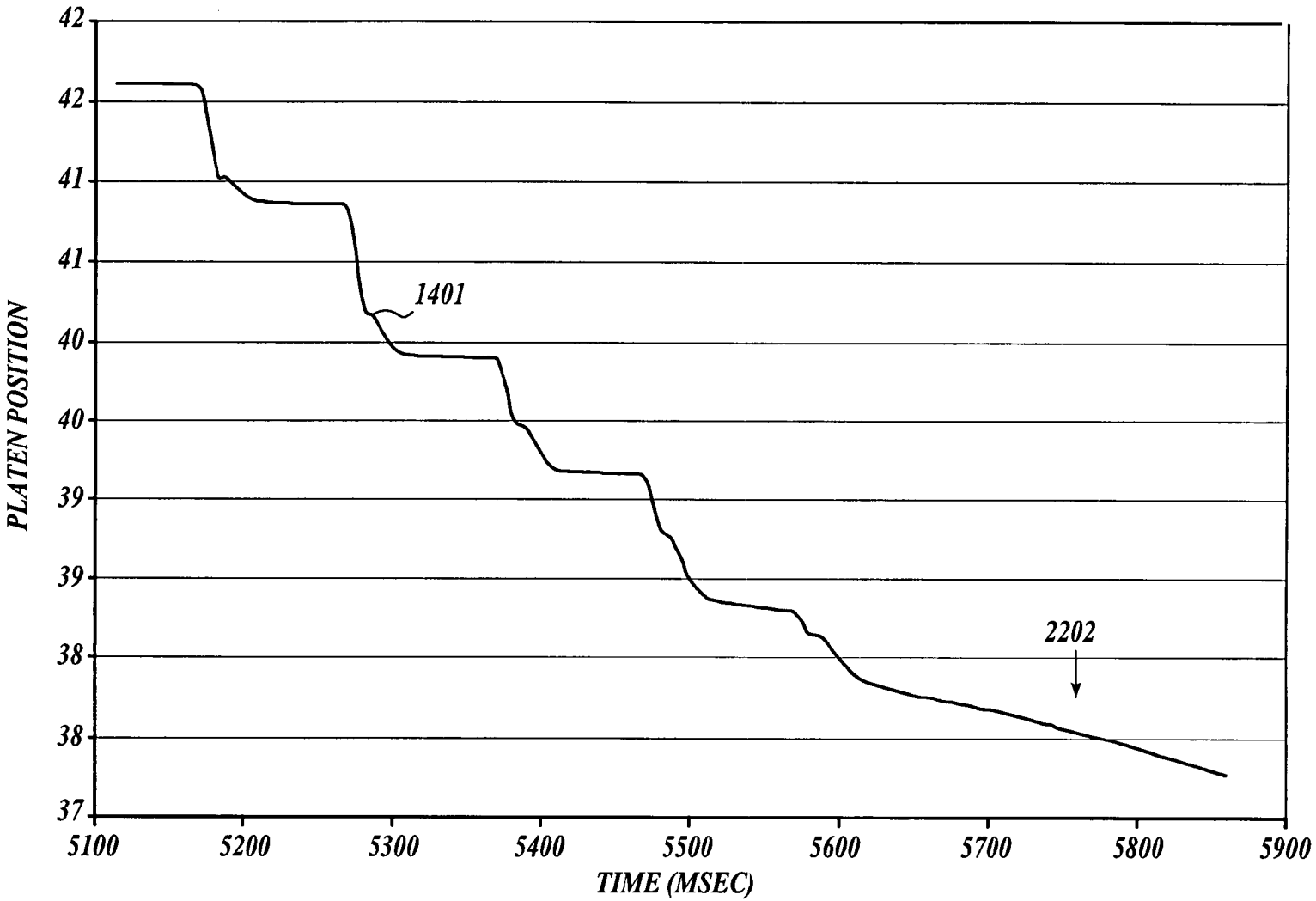
FIG. 20 is a graphical illustration of the platen position measured in motor steps versus time in milliseconds for a print gap setting method.

In FIG. 12, stages 7A, 7B, and 7C are at location 1414. In FIG. 19, from line 1401, it can be seen that the stepper motor 308 is commanded to move the platen 318 toward the fully closed position to reduce the print gap in half-step increments. The difference between sensor 310 readings of successive moves is then summed. The sum of the last four differences is then compared to a threshold. If the sum is greater than the threshold, the gap is again decreased by one half-step and the new sum compared. This continues until the sum is less than the threshold, indicating that the motor has stalled or is beginning to stall because the sensor 310 reading is lagging the motor step. The platen 318 compressing the paper 316 and ribbon 314 against the hammers 304 is a gradual process. The motor 308 does not really stop as the platen 318 begins to press the paper 316 and ribbon 314 against the hammers 304, but does not travel as far as the commanded position. The resisting force increases as the individual hammers 304 push further into the paper and ribbon. Eventually, the resisting forces become greater than the available torque supplied by the stepper motor 308, and the platen 318 stops.

Figure 22:
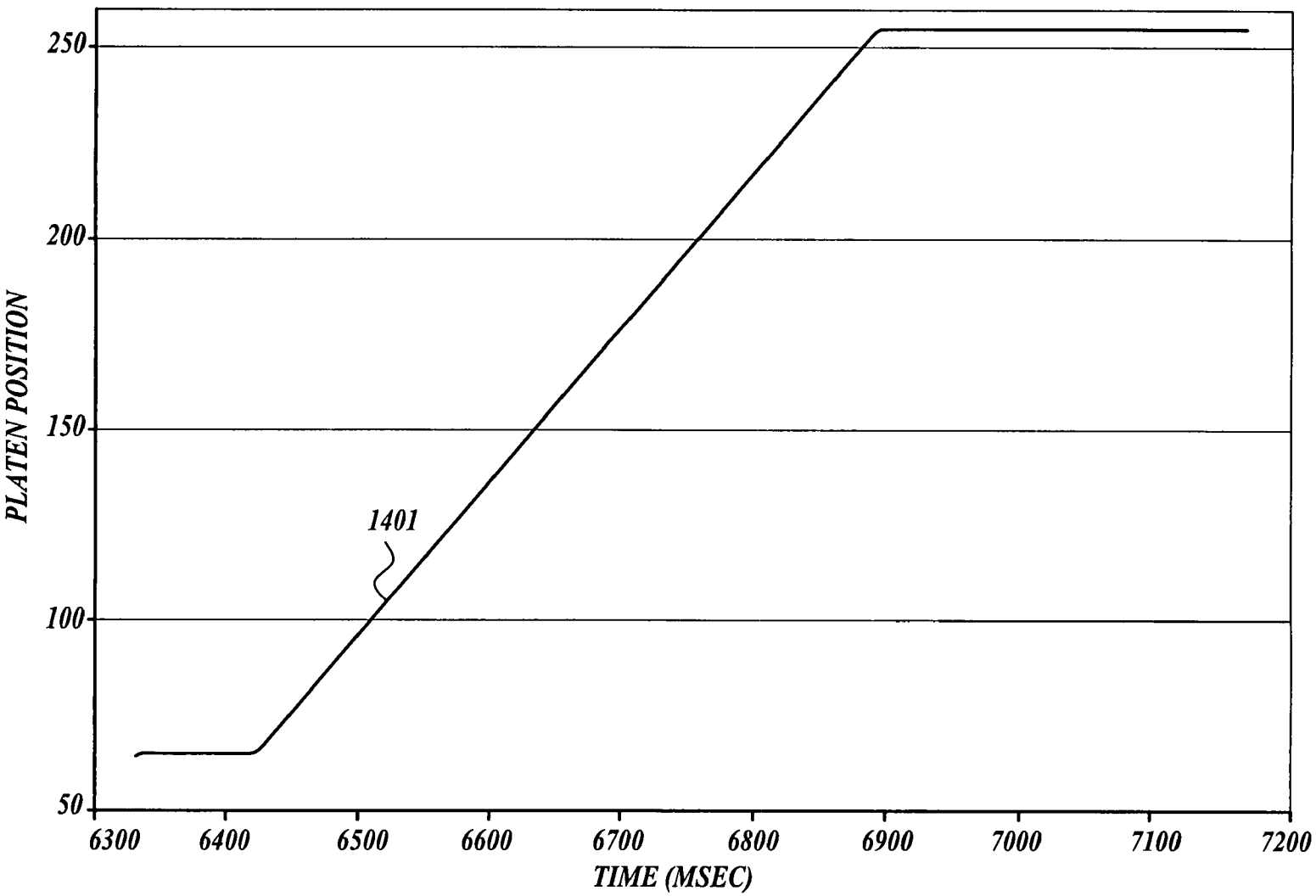
FIG. 22 is a graphical illustration of the platen position measured in motor steps versus time in milliseconds for a print gap setting method.

Referring to FIG. 11, at stage 8, block 1140 is entered when the sum of differences is less than a threshold. If the threshold is set correctly, the entry to stage 8, block 1140, may be at the point of motor 308 maximum torque. In block 1140, the method 1100 determines the print gap based on the crush point. The crush point value is the motor 308 step equal to the IDX value from the control table that is associated with the sensor value that matches the current sensor 310 reading when the determination in decision block 1132 is FALSE. The optimal print gap can be determined by adding the back-off value obtained from the control table to the crush point value. In FIG. 14, stage 8 is at location 1416. In FIG. 22, at stage 8, from the line 1401, it can be seen that the stepper motor 308 is unable to move the platen 318 to the commanded position due to the resistance of the paper, and the sensor 310 reading is lagging the commanded step. The differences between successive sensor 310 readings begin decreasing until a sum of differences is less than the threshold and the method 1100 ceases further attempts at driving the platen 318 towards fully closed. The last sensor 310 reading is compared to the IDX values in the control table, and the IDX value that matches with the sensor 310 reading becomes the crush point, as measured in motor steps. The print gap setting can be obtained from a correlation of the crush point (in motor step) versus print gap (in motor step), such as represented by FIG. 6, for example.

Referring to FIG. 11, from block 1140, the method 1100 may enter stage 9A, block 1142. Stage 9 is composed of two stages, 9A and 9B that, combined, ensure the motor 308 rotor synchronization with the electrical step, and move the platen 318 to the optimal print gap.

At stage 9A, block 1142, the method 1100 commands the stepper motor 308 to move the platen 318 one half-step toward the fully open position. A counter is initiated and is incremented by one for every command. The method 1100 stays in stage 9A, block 1142, as long as the counter is less than four. When the counter has counted to four, the method 1100 enters stage 9B, block 1144. At block 1144, the method 1100 commands the stepper motor 308 to move the platen 318 towards the fully open position to the corresponding back-off position for the determined crush point from the control table. The variable IDX is set to the previous IDX value plus the back-off position from the control table. From stage 9B, block 1144, the method 1100 enters decision block 1146. At decision block 1146, the method 1100 determines whether the printer is ready to begin printing by determining whether there is available data to print. If the determination in decision block 1146 is TRUE, the method 1100 enters decision block 1150. If the determination in decision block 1146 is FALSE, the method 1100 enters stage 10, block 1148.

Figure 21:
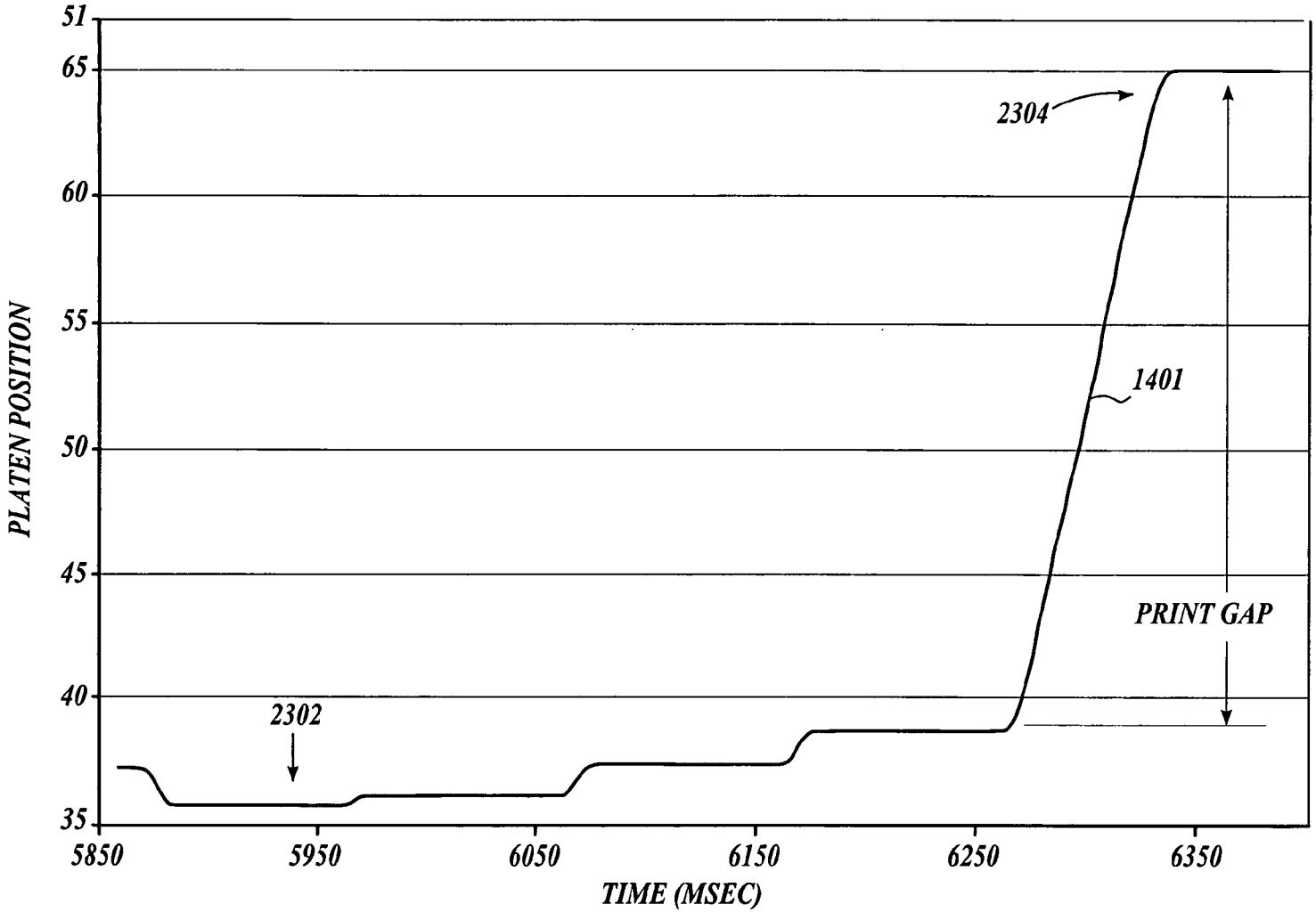
FIG. 21 is a graphical illustration of the platen position measured in motor steps versus time in milliseconds for a print gap setting method.

In FIG. 12, stage 9 is at location 1418. In FIG. 21, at stage 9, from the line 1401, it can be seen that the platen 318 is commanded toward the fully open position to back away from the paper 316 by four half-step increments. Since the previous moves were retarded by the presence of the paper 316, the rotor is lagging the actual electrical step position. Therefore, when the high torque move in the direction toward fully open is commanded, the platen 318 moves slightly in the opposite direction, i.e., towards fully closed 2302. Subsequent steps move the platen 318 in the correct direction, i.e., towards the fully open position. These four moves are meant to put the stepper motor 308 rotor back into a stable state. Thereafter, the platen 318 may be commanded to move to the optimal print gap 2304 determined from the back-off value from the control table. The stepper motor 308 is commanded to go to the step which is the sum of the crush point value and the back-off value. If the printer has data, printing may begin at this point. Otherwise, the platen 318 may go to the fully open position.

Referring to FIG. 11, at stage 10, block 1148, the method 1100 commands the stepper motor 308 to move the platen 318 to the fully open position, which in terms of the number of motor steps is equivalent to the fully open position (255) minus the current IDX value. After the move, the IDX variable is set to 255. From stage 10, block 1148, or from decision block 1146, the method 1100 enters decision block 1150.

In FIG. 12, stage 10 is illustrated at location 1420. In FIG. 22, at stage 10, from the line 1401, it can be seen that if there is no data currently available for printing, the platen 318 may be commanded to go to the fully open position. This puts the platen 318 at step position 255.

Referring to FIG. 11, blocks 1150 and 1152 define when and how to implement a correction process, defined by the broken line box 1155, for the platen 318 before actual printing commences. The determination in decision block 1150 is whether the sensor 310 reading is within the control table sensor value to within the tolerance factor. If the determination in decision block 1150 is TRUE, the method 1100 continuously determines whether the sensor 310 reading is within the tolerance factor of the sensor value from the control table. When the determination in decision block 1150 is FALSE, the method 1100 enters block 1152. In block 1152, the method 1100 sets a corrected IDX value equal to the IDX value from the control table that is associated with the sensor value that most closely matches the current sensor 310 reading. The method 1100 commands the stepper motor 308 to make an adjustment in steps equal to the corrected IDX value less the current IDX value. The variable IDX is set to the corrected IDX value. Decision block 1150 and block 1152 are an optional feature of the method 1100.

Figure 23:
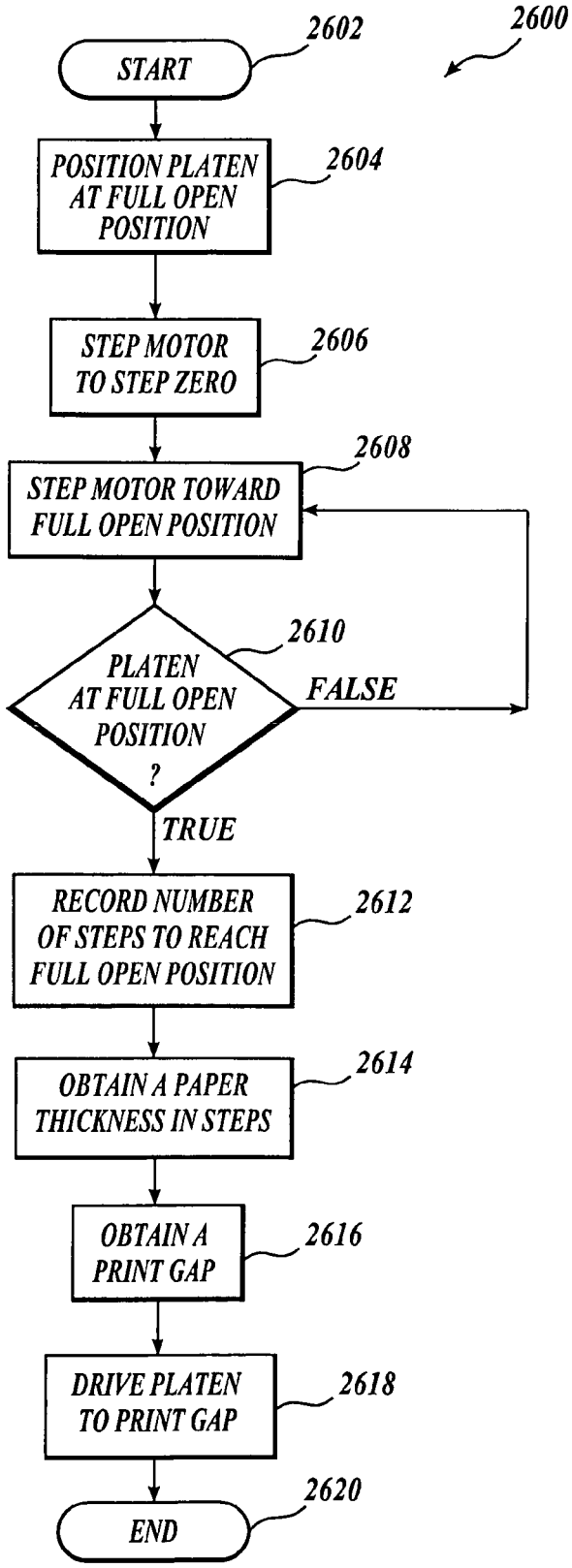
FIG. 23 is a flow diagram of an alternate method for setting the print gap.

Having described an embodiment of a method for determining the paper thickness and print gap with a printer assembly having a stepper motor 308, eccentric platen 318, and motor rotor sensor 310, an embodiment of an alternate method 2600 for determining the paper thickness using an eccentric platen 318 and stepper motor 308 without a position feedback sensor, like sensor 310, is illustrated in FIG. 23.

Referring to FIG. 23, the method 2600 begins at start block 2602. From block 2602, the method 2600 may enter block 2604. In block 2604, the platen 318 may be set to a known reference position. For example, the platen 318 may be driven to the fully open position. A limit switch may be used to indicate the fully open position. From block 2604, the method 2600 may enter block 2606.

In block 2606, the stepper motor 308 may be stepped to step zero (0), so as to drive the platen 318 against the paper 316. From block 2606, the method 2600 may enter block 2608. In block 2608, the stepper motor 308 direction is reversed, and the stepper motor 308 is stepped to move the platen 318 in selected increments towards the full open position. A running sum of steps may be kept in block 2608. From block 2608, the method 2600 may enter decision block 2610. In decision block 2610, a determination is made whether the platen 318 is at the full open position. If the determination in decision block 2610 is FALSE, the method 2600 may re-enter block 2608 to continue driving the stepper motor 308 and moving the platen 318 toward the full open position. If the determination in decision block 2610 is TRUE, the method 2600 may enter block 2612. In block 2612, the number of stepper motor 308 steps needed for the platen 318 to reach the full open position is recorded. Without a sensor 310 to detect when the stepper motor 308 has stalled against the paper 316, stepper motor 308 is commanded through all the steps to finish at step zero (0) in block 2606. When the platen 318 inevitably contacts the paper 316, the stepper motor 308 rotor will begin to lag the commanded step position. Once the rotor lags the commanded position by 180 degrees electrically, for example, the torque generated by the motor will go to zero. At this point, additional step commands will not compress the paper any further. Not having a sensor to feedback whether the stepper motor 308 rotor is actually moving, there is no way of determining at what step the stepper motor 308 has stalled when encountering the paper 316. It is assumed that the stepper motor 308 will have stalled by encountering the paper 316 at some step between the fully open position and step zero (0). With the stepper motor 308 at step zero (0), the stepper motor 308 direction is reversed, and the stepper motor 308 is stepped until the reference position at the opposite limit to the paper is detected, such as by a limit switch. The number of steps is tracked during this command, block 2608. The number of steps should be less than the total steps capable by stepper motor 308 because the paper 316 and ribbon 314 would have stalled the stepper motor 308 before the stepper motor 308 traveled the full range of steps towards step zero (0). From block 2612, the method 2600 enters block 2614.

In block 2614, the method 2600 obtains the paper 316 thickness by subtracting the number of steps recorded in block 2612 from the total number of possible steps. The result will be a measure of the paper 316 thickness. However, the thickness may be the thickness at the crush point (at stepper motor maximum torque), or the thickness may be the thickness at the position when the platen 318 makes initial contact. Alternatively, the thickness may be any point in between the two extremes. In contrast to the previous embodiment that could apply a consistent compression force by providing motor rotor position feedback, the lack of feedback on the motor rotor position prevents applying a consistent compression force, or the maximum compression point consistently. From block 2614, the method 2600 may enter block 2616.

In block 2616, assuming that a correlation has been prepared that plots a measure of the thickness as a motor step versus the print gap 332, also expressed as a motor step, the print gap 332 can be expressed as a target stepper motor step. From block 2616, the method 2600 may enter block 2618. If so desired and ready to begin printing, the motor 308 may drive the platen 318 to the appropriate print gap 332, expressed as a motor step, in block 2618. From block 2618, the method 2600 enters block 2620. In block 2620, the method 2600 has completed one iteration.

The process just described of overstepping the motor 308 when a sensor 310 is not provided involves commanding many individual stepper motor 308 steps. While this is a viable method, overstepping the motor 308 has some disadvantages. When the platen 318 begins to compress the paper 316, the rotation of the stepper motor 308 rotor will be retarded. Once the rotor position lags the commanded step position by more than 180 degrees, the stepper motor 308 will spin backwards. In the case of half-stepping, this will occur at lag distances greater than four half-steps. If another half-step is commanded, the rotor will be pulled backwards by three half-steps to align with the currently energized stator pole. At this point, the rotor and electrical step position will again be synchronized, but at a loss of one full electrical cycle, or eight half-steps. This process will repeat until no more steps are commanded. Depending upon the angle between the last commanded step (step 0) and the rotor in block 2606, the platen 318 could be just touching the paper 316, compressing the paper 316 at maximum torque, backed off the paper 316, or anywhere in-between. Since the thickness of the paper 316 is determined by counting the number of steps it takes to go from this position to the fully open position, the thickness is only known to a plus or a minus 4 half-step accuracy.

Another problem with overstepping is that overstepping does not apply a uniform force to the paper 316. When the platen 318 contacts the paper 316, the force applied will rise as the angle between the commanded step and rotor position increase. It will peak at an angle of 90 degrees and then decline to zero once the angle reaches 180 degrees. Past 180 degrees, the platen 318 will move away from the paper 316 with successive step commands, starting the process over. This will create a jack-hammering effect on the paper 316 with a duration that is proportional to the paper 316 thickness. Each time the compression force peaks, the impact hammers 304 will be driven deeper into the paper 316. This will result in thicker paper being compressed further than thin paper.

Another problem with overstepping is the amount of time it takes to detect the thickness of the paper 316. The detection of paper thickness requires the platen 318 to cycle from fully open, to step zero (0), and back to fully open. The optimal print gap 332 cannot be set until this whole process is complete. With thick paper, only a few steps need to be commanded to bring the platen 318 from the fully open position to contact with the paper 316. Nevertheless, the total number of steps that define the full range of platen 318 travel must be generated regardless of this fact, which results in time wasted jack-hammering the platen 318 into the paper 316.

As described above, it becomes possible to take a measure of a printing medium thickness, such as paper 316, and setting a print gap 332 based on a measure of the paper thickness using an eccentric platen 318 and stepper motor 308. The measure of the paper 316 thickness is determined by applying a force to the paper 316 with the eccentric platen 316. In one embodiment described, it is possible to add a sensor 310 that indicates the position of the stepper motor 308 and platen 318. This embodiment may apply a consistent force to the paper 316 regardless of paper thickness, which efficiently renders detection when the platen 318 has encountered the paper 316. In another embodiment, the sensor 310 may be omitted. However, a way of detecting when the platen 318 has reached the full open position becomes necessary. This second embodiment has the aforementioned disadvantages, such as not being able to apply a consistent force to the paper 316 and the need to cycle through all possible motor steps, making this second embodiment less efficient than the first. While two examples have been provided, it should be understood that the invention should not be limited to any one particular embodiment. For example, a third embodiment is possible, whereby a direct measure of the paper 316 thickness is possible with a sensor dedicated to obtaining the thickness by a direct measurement of the paper 316. A fourth embodiment may be envisioned where the paper 316 thickness is provided, for example, on the packaging of the paper 316. The printer operator may then enter the paper 316 thickness via an interface into the printer's computer system, which then calculates the appropriate print gap. This fourth embodiment may obviate the need to determine the paper 316 thickness with the printer. With all the embodiments of determining paper 316 thickness, if the paper 316 thickness is known, it is possible to set the appropriate print gap 332 with an eccentric platen 318.

Furthermore, the stepper motor 308 is one example of a driver to move the eccentric platen 316. Drivers other than stepper motors may be used. It may also be possible to directly measure the motor torque to determine when the measure of the paper 316 thickness should be recorded. Accordingly, the invention should not be construed to be limited to any one particular driver.

In a further aspect, with the ability to determine the printing medium thickness, it becomes possible to implement other printer features that may take advantage of the thickness measuring procedure. In another aspect of the invention, the determination of the print gap based on a single measure of thickness can be used multiple times on a single, representative printing medium for multiple measurements of the thickness at several locations, and setting different print gaps at each location. For example, forms that include adhesive labels are thicker in some parts of the form and require a different print gap as compared with the remainder of the form. Different print gaps are needed at different locations on the form.

Printing will often need to be done on both the thin and thick parts of a form. In order to achieve consistently good print quality, the print gap needs to be larger for the thicker areas. Accordingly, a method can be implemented wherein the thickness of a representative form at several locations can be determined. This record of the thicknesses and the corresponding locations, and corresponding print gaps, is an example of a "profile" of the form. The profile of a representative form can be stored in computer memory, and this profile can be recalled whenever a similar form is being printed. The printer is provided with a print gap profile including the thicknesses and the corresponding locations for a specified form. A printer as described above, already capable of automatically selecting one print gap for a given thickness, could be used to automate location identification, as well as to automatically assign print gap settings to these locations. Different print gap locations may occur horizontally from top to bottom on the paper 316. The optimal print gap setting process described above for a form of a substantially uniform thickness can be conducted for a form at every ⅙" vertical distance, for example. After the profile for a representative form has been completed, the form can be removed from the printer. Since the process of sampling form thickness may crush the form to the point where the hammer marks show, it is preferred that a profiling procedure be done on a sample representative form that can be discarded after the profile is made. Once the profile for a representative form has been generated and saved, that profile can then be applied any time in the future to print jobs that use a similar form. As printing on a new form progresses, the eccentric platen 318 will adjust the print gap 332 from location to location by referencing the profile previously determined for the sample representative form.

Form thickness sampling at various locations may be implemented by any one of the embodiments for taking the measure of thickness, already described above. For example, at various locations on the paper, the paper 316 thickness and optimal print gap is determined by driving the platen 318 toward fully closed and monitoring the movement with the sensor 310. For setting a print gap 332 for a uniformly thick paper 316 from top to bottom a single optimum print gap setting is computed. However, for profiling, many thickness measurements from one end to the other, i.e., from top to bottom, need to be taken.

One implementation of a method for automatically profiling the form thickness from top to bottom includes adjusting the print gap 332 to the widest allowable print gap 332 for printing. Then, moving the paper 316 forward an incremental distance, for example, one line height. Then, moving the ribbon 314 forward so that the ribbon 314 is moved enough to have a fresh ribbon 314 in front of the platen 318, which minimizes error. As long as the minimum gap distance is not reached, the print gap 332 is decreased by some small incremental distance and the sensor 310 reading is taken. When the minimum gap is found, the sensor 310 reading is saved that corresponds with the paper location. Once the entire form is scanned vertically from top to bottom, form thickness sampling is complete. A profile table of saved sensor 310 readings and paper 316 location data can be created that maps the thicknesses and locations for an entire form. The optimum print gap 332 can be assigned to each location based on the measure of the thickness. When a profile table has been established, printing may commence on forms similar to the one that has been used to generate the profile table. Whenever paper 316 is to be advanced during a print job, the profile table may be consulted first to determine what print gap should be applied at each location. If the current print gap setting already matches, printing will proceed; however, if the print gap 332 from the profile table does not match the current print gap 332, the print gap 332 will need to be changed. It is important to ensure that the print gap change be done prior to moving the paper 316 in order to avoid pinching if the print gap 332 moves from a thin location to a thicker location. For similar reasons, if the print gap 332 is to decrease, the print gap change should be done after moving the paper 316. When the print gap 332 needs to be changed, printing should pause while the platen 318 adjusts to the new position.

Figure 25:
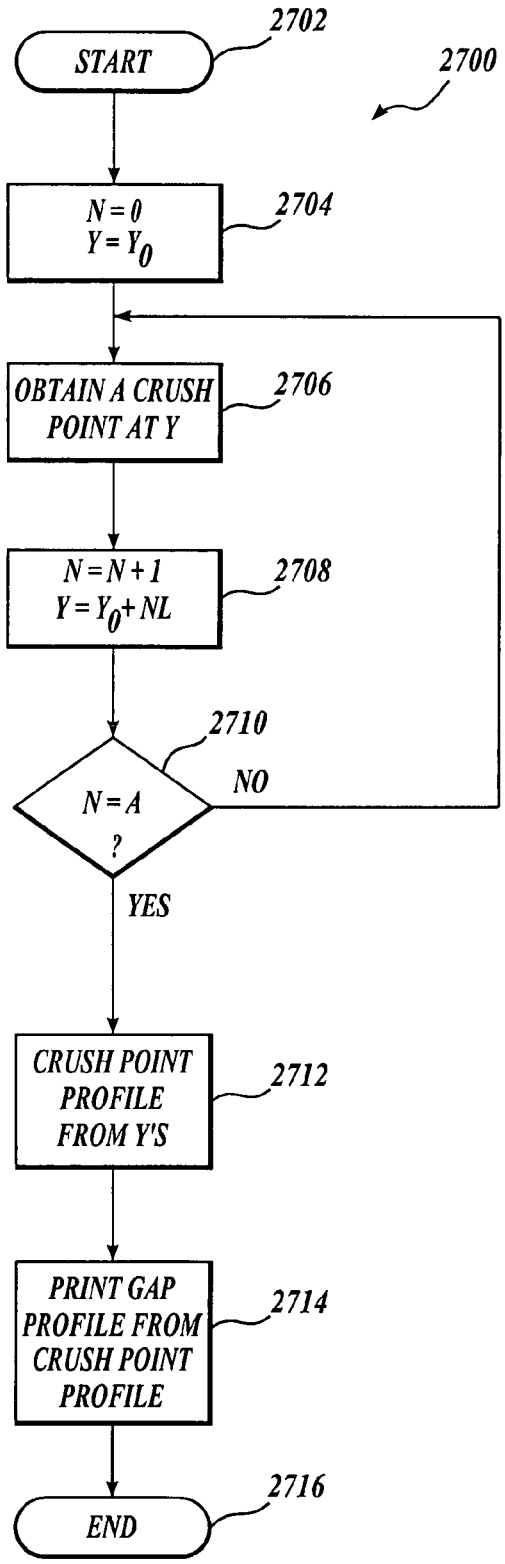
FIG. 25 is a flow diagram of a method for providing a print gap profile.

Referring now to FIG. 25, a flow diagram for a representative method 2700 of measuring multiple thicknesses or crush points of one representative print medium, such as a form, is provided. Method 2700 is useful for obtaining multiple thicknesses of a form and matching each thickness with a location and print gap such that a profile table may be generated and referenced whenever similar forms may be printed in the future. From the plots of crush point versus print gap, and print gap versus motor step, multiple print gap settings can be determined for the entire form from top to bottom, and the printer can be adjusted to vary the print gap at the desired location of printing.

Method 2700 begins at start block 2702. From start block 2702, method 2700 enters block 2704. At block 2704, counter "N" is initialized to zero, and the location "Y" is initialized to the initial location. Y represents the location on the form being measured for thickness or crush point. N counts the number of thickness measurements for one form.

From block 2704, method 2700 enters block 2706. In block 2706, the form thickness at location Y is determined, which in the first instance may be the initial location $Y_0$. From block 2706, the method 2700 enters block 2708. In block 2708, the counter is incremented by one, and the location at which the next form thickness will be determined may be calculated by adding a predefined distance L multiplied by the counter value to the initial location $Y_0$. The distance L may be any resolution. In other words, N can be 2 or N can be the number of print lines, which corresponds to having a form thickness measurement for each line of print. Thus, for every subsequent location Y, Y is $Y_0$ added to N multiplied by L. From block 2708, the method 2700 enters decision block 2710. In decision block 2710, a determination is made whether the counter is equal to the predetermined number of iterations, A, for determining the thickness of the form. If the determination in decision block 2710 is NO, the method 2700 returns to block 2706 to determine the form thickness at the new location. If the determination in decision block 2710 is YES, the method 2700 may enter block 2712, wherein the measuring of thicknesses at multiple locations of the form is completed. The data may be represented as a table (profile table) of values wherein one set of values represents the locations on the form, and a second set of values is the thickness of the form corresponding to each location. From block 2712, the method 2700 may enter block 2714.

In block 2714, the appropriate print gap 332 for each measurement of thickness may be assigned and correlated to each location. The optimal print gap at each location may be determined from a plot of the optimal print gap versus form thickness.

The information may be represented as a table as shown below in Table 2, wherein Y is the location on the form, t is the measure representative of thickness, and d is the print gap distance. Once print gap settings for every location on the form are determined, the table may be saved to the printer's computer memory and recalled when printing forms similar to the form that has been profiled. From block 2714, the method 2700 enters block 2716. In block 2716, the method 2700 has completed one profile for one form.

Thereafter, printing on similar forms as the one profiled will entail referencing a profile table, obtaining the printing location, and determining whether the print gap corresponds to the print gap from the table. If the answer is YES, printing may proceed. However, if the answer is NO, the printer obtains the new print gap, and the eccentric platen 318 is moved to set the correct print gap for the new location from the table, and printing may proceed. When the printer determines once again that a new location has been reached for which information is recorded, the process is repeated.

TABLE 2

| | | |
|---|---|---|
| $Y_0$ | $t_0$ | $d_0$ |
| $Y_1$ | $t_1$ | $d_1$ |
| $Y_2$ | $t_2$ | $d_2$ |
| $Y_n$ | $t_n$ | $d_n$ |

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for setting a print gap of a printer, comprising rotating an eccentric platen with a driver to set the print gap according to a measure of the thickness of a printing medium obtained through the application of a force against the printing medium, wherein to obtain a measure of the thickness of the printing medium, the platen is moved against the printing medium in coarse increments until sensing that the driver loses synchronization, thereafter the driver is synchronized, and thereafter the platen is moved against the printing medium in fine increments.

2. The method of claim 1, further comprising sensing the position of the platen.

3. The method of claim 1, wherein the application of the force against the printing medium is representative of the printing medium thickness.

4. The method of claim 1, wherein a stepper motor is commanded to rotate the eccentric platen.

5. The method of claim 1, further comprising measuring the torque of the driver that rotates the eccentric platen.

6. The method of claim 1, further comprising tracking the steps of the driver that rotates the eccentric platen.

7. The method of claim 1, further comprising having the ability to apply a substantially similar force irrespective of the thickness of the printing medium.

8. The method of claim 1, further comprising having the ability to take a measure of the printing medium thickness at the maximum torque produced by the driver.

9. The method of claim 1, wherein the driver direction is reversed to synchronize the driver.

10. The method of claim 1, wherein the driver does not lose synchronization when moved against the printing medium in fine increments.

11. The method of claim 1, wherein the measure of the thickness is determined by the position of the platen after moving in fine increments.

12. The method of claim 1, wherein the platen position is sensed by a sensor, and the loss of synchronization is determined when the sensor reading fails to match a predetermined sensor value that corresponds to an electrical step by more than a tolerance factor.

13. The method of claim 1, wherein the platen position is sensed by a sensor, and the printing medium thickness is determined when the difference between successive sensor readings is below a threshold.

14. A method for printing on a printing medium of varying thickness, comprising:

obtaining more than one location on a printing medium;

obtaining a measure of the thickness of the printing medium at each location;

determining a print gap at each location and storing the locations and print gaps; and when printing at similar locations of a similar printing medium, setting the print gaps in accordance with predetermined print gaps at each location, wherein to obtain a measure of the thickness of the printing medium, the platen is moved against the printing medium in coarse increments until sensing that a driver that drives the platen loses synchronization, thereafter the driver is synchronized, and thereafter the platen is moved against the printing medium in fine increments.

15. The method of claim 14, further comprising rotating an eccentric platen to set the print gap.

16. The method of claim 14, wherein each location of the printing medium at which a measure of the thickness is obtained is vertically disposed in relation to each other.

17. The method of claim 14, wherein a representative printing medium is profiled for thickness at more than one location, and the thickness profile of the representative printing medium is stored for later setting the print gap of printing media similar to the representative medium.

18. The method of claim 14, wherein the measure of the thickness of the printing medium is obtained through the application of a force by a platen against the printing medium.

19. The method of claim 14, wherein the measure of the thickness of the printing medium is obtained through the application of a force by a platen against the printing medium, and a driver that drives the platen is applying the maximum torque.

20. The method of claim 14, wherein the driver direction is reversed to synchronize the driver.

21. The method of claim 14, wherein the driver does not lose synchronization when moved against the printing medium in fine increments.

22. A method of claim 14, wherein the measure of the thickness is determined by the position of the platen after moving in fine increments.

23. The method of claim 14, wherein the platen position is sensed by a sensor, and the loss of synchronization is determined when a sensor reading fails to match a predetermined sensor value that corresponds to an electrical step by more than a tolerance factor.

24. The method of claim 14, wherein the platen position is sensed by a sensor, and the printing medium thickness is determined when the difference between successive sensor readings is below a threshold.

25. A method for setting the print gap for a printer having an eccentric platen driven by a stepper motor controlled by inputting electrical steps, comprising:

moving the platen in large increments of steps to reduce the print gap;

when the platen encounters the printing medium, moving the platen to synchronize the motor with an inputted electrical step;

moving the platen in small increments of steps to reduce the print gap;

when the platen encounters the printing medium, recording the position of the platen and moving the platen to synchronize the motor with an inputted electrical step;

based on the recorded position of the platen, obtaining a print gap setting; and moving the platen the appropriate amount to achieve the print gap setting.

26. A method for setting a print gap of a printer, comprising rotating an eccentric platen to set the print gap according to a measure of the thickness of a printing medium obtained through the application of a force against the printing medium and measuring the torque of a driver that rotates the eccentric platen.

27. A method of setting a print gap of a printer using a platen driven by a motor, comprising:

driving the platen a first and a second time against the printing medium, wherein the second time that the platen is driven against the printing medium is after the motor has been synchronized after losing synchronization the first time that the platen is driven against the printing medium, and determining the print gap after the second time that the platen is driven against the printing medium.

28. A method of setting the print gap between an eccentric platen and a print head using a sensor that indicates platen position and a stepper motor that rotates the platen, comprising:

obtaining sensor values corresponding to electrical steps of the stepper motor;

commanding the stepper motor to step the platen against a printing medium at a first rate and obtaining a reading with the sensor after a command;

comparing the sensor reading with a predetermined sensor value corresponding to the commanded electrical step for the stepper motor;

after the sensor reading and the sensor value fail to match by more than a tolerance factor, commanding the stepper motor to step the platen away from the printing medium;

after the sensor reading and the sensor value match to within a tolerance factor, commanding the stepper motor to step the platen against the printing medium at a second rate and obtaining a reading with the sensor after a command; and when the difference between successive sensor readings is below a threshold, setting the print gap from the sensor reading.

29. A method of setting the print gap between a platen and a print head using a driver that drives the platen, comprising:

commanding the driver to drive the platen against a printing medium at a first rate and obtaining the platen position after a command;

after the platen position does not reach the commanded position, commanding the driver to drive the platen away from the printing medium;

after the platen position reaches the commanded position, commanding the driver to drive the platen against the printing medium at a second rate; and when the difference between successive platen positions is below a threshold, setting the print gap from the platen position.

* * * * *